US008305404B2

(12) United States Patent
Hosaka

(10) Patent No.: US 8,305,404 B2
(45) **Date of Patent: *Nov. 6, 2012**

(54) ELECTRO-OPTICAL APPARATUS, METHOD OF DRIVING SAME, AND ELECTRONIC APPARATUS

(75) Inventor: Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1179 days.

This patent is subject to a terminal disclaimer.

(21) Appl. No.: 12/132,313

(22) Filed: Jun. 3, 2008

(65) Prior Publication Data

US 2009/0002295 A1 Jan. 1, 2009

(30) Foreign Application Priority Data

Jun. 28, 2007 (JP) ..... 2007-170081

(51) Int. Cl.
*G09G 5/10* (2006.01)

(52) U.S. Cl. ..... 345/691; 345/690; 345/692; 345/693; 345/63; 345/89; 345/100; 345/204; 345/77

(58) Field of Classification Search ..... 345/63, 345/76, 77, 82–100, 690–693, 204
See application file for complete search history.

(56) References Cited

U.S. PATENT DOCUMENTS

| | | | | |
|---|---|---|---|---|
| 5,619,228 | A * | 4/1997 | Doherty | 345/693 |
| 7,088,325 | B2 * | 8/2006 | Ishii | 345/89 |
| 7,106,351 | B2 * | 9/2006 | Ito | 345/692 |
| 7,227,561 | B2 * | 6/2007 | Doyen et al. | 345/691 |
| 7,322,095 | B2 | 1/2008 | Guan et al. | |
| 7,339,557 | B2 * | 3/2008 | Ochi | 345/63 |
| 7,429,968 | B2 * | 9/2008 | Aiba et al. | 345/63 |
| 7,479,972 | B2 | 1/2009 | Takai | |
| 7,755,651 | B2 * | 7/2010 | Kimura | 345/691 |
| 7,884,790 | B2 | 2/2011 | Sakurai | |
| 7,884,813 | B2 * | 2/2011 | Seki | 345/204 |
| 7,973,809 | B2 * | 7/2011 | Hosaka et al. | 345/690 |
| 2005/0057852 | A1 | 3/2005 | Yazawa et al. | |
| 2005/0141137 | A1 | 6/2005 | Okada et al. | |
| 2006/0061603 | A1 * | 3/2006 | Kort et al. | 345/691 |
| 2006/0152459 | A1 * | 7/2006 | Shin | 345/94 |
| 2006/0245108 | A1 | 11/2006 | Hsu et al. | |
| 2009/0153458 | A1 * | 6/2009 | Kojima et al. | 345/89 |
| 2009/0195561 | A1 * | 8/2009 | Iisaka et al. | 345/690 |

FOREIGN PATENT DOCUMENTS

| | | |
|---|---|---|
| CN | 1897081 A | 1/2007 |
| JP | A-2003-114661 | 4/2003 |
| JP | A 2003-216106 | 7/2003 |
| JP | A-2005-92929 | 4/2005 |
| JP | A-2005-174449 | 6/2005 |
| JP | A-2005-190518 | 7/2005 |
| JP | A-2005-310363 | 11/2005 |
| JP | A-2006-309930 | 11/2006 |

* cited by examiner

*Primary Examiner* — Lun-Yi Lao
*Assistant Examiner* — Gregory J Tryder
(74) *Attorney, Agent, or Firm* — Oliff & Berridge, PLC

(57) ABSTRACT

One field is divided into p (p is an integer of 2 or more) groups and each of the divided groups is divided into two subfields. The p groups have the same time period. The sub-fields forming one field have time periods that are different from each other. A plurality of scanning lines are divided into at least first and second groups. A field start timing of pixels corresponding to the scanning lines of the first group is set to be different from a field start timing of pixels corresponding to scanning lines of the second group by at least the time period of the groups.

7 Claims, 22 Drawing Sheets

FIG. 5

30

| | | SUB-FIELD | | | | | | | | |
|---|---|---|---|---|---|---|---|---|---|---|
| | | sf1 | sf2 | sf3 | sf4 | sf5 | sf6 | sf7 | sf8 | sf9 |
| GRAY-SCALE LEVEL | 0 | 0 | 0 | 0 | 0 | 0 | 0 | 0 | 0 | 0 |
| | 1 | 1 | 0 | 0 | 0 | 0 | 0 | 0 | 0 | 0 |
| | 2 | 0 | 0 | 0 | 0 | 0 | 1 | 0 | 0 | 0 |
| | 3 | 0 | 0 | 1 | 0 | 0 | 0 | 0 | 0 | 0 |
| | 4 | 0 | 0 | 0 | 0 | 0 | 0 | 0 | 1 | 0 |
| | 5 | 0 | 0 | 0 | 0 | 0 | 0 | 0 | 0 | 1 |
| | 6 | 0 | 0 | 0 | 1 | 0 | 0 | 0 | 0 | 0 |
| | 7 | 0 | 0 | 0 | 0 | 0 | 0 | 1 | 0 | 0 |
| | 8 | 0 | 1 | 0 | 0 | 0 | 0 | 0 | 0 | 0 |
| | 9 | 0 | 0 | 0 | 0 | 1 | 0 | 0 | 0 | 0 |
| | 10 | 1 | 0 | 0 | 0 | 0 | 0 | 0 | 1 | 1 |
| | 11 | 0 | 0 | 0 | 0 | 1 | 1 | 0 | 0 | 0 |
| | 12 | 1 | 1 | 1 | 0 | 0 | 0 | 0 | 0 | 0 |
| | 13 | 0 | 0 | 0 | 0 | 0 | 1 | 1 | 1 | 0 |
| | 14 | 1 | 1 | 0 | 0 | 0 | 0 | 0 | 0 | 1 |
| | 15 | 0 | 0 | 0 | 1 | 1 | 0 | 0 | 0 | 0 |
| | 16 | 0 | 0 | 0 | 0 | 0 | 0 | 1 | 1 | 1 |
| | 17 | 0 | 1 | 1 | 1 | 0 | 0 | 0 | 0 | 0 |
| | 18 | 0 | 0 | 0 | 0 | 1 | 1 | 1 | 0 | 0 |
| | 19 | 1 | 0 | 0 | 0 | 0 | 1 | 1 | 1 | 1 |
| | 20 | 0 | 0 | 1 | 1 | 1 | 1 | 0 | 0 | 0 |
| | 21 | 1 | 1 | 1 | 0 | 0 | 0 | 0 | 1 | 1 |
| | 22 | 0 | 0 | 0 | 0 | 1 | 1 | 1 | 1 | 0 |
| | 23 | 1 | 1 | 1 | 1 | 0 | 0 | 0 | 0 | 1 |
| | 24 | 0 | 0 | 0 | 1 | 1 | 1 | 1 | 0 | 0 |
| | 25 | 1 | 1 | 0 | 0 | 0 | 0 | 1 | 1 | 1 |
| | 26 | 0 | 1 | 1 | 1 | 1 | 0 | 0 | 0 | 0 |
| | 27 | 0 | 0 | 1 | 1 | 1 | 1 | 1 | 0 | 0 |
| | 28 | 1 | 0 | 0 | 0 | 1 | 1 | 1 | 1 | 1 |
| | 29 | 1 | 1 | 1 | 1 | 1 | 1 | 0 | 0 | 0 |
| | 30 | 1 | 1 | 1 | 0 | 0 | 1 | 1 | 1 | 1 |
| | 31 | 0 | 0 | 1 | 1 | 1 | 1 | 1 | 1 | 0 |
| | 32 | 1 | 1 | 1 | 1 | 1 | 0 | 0 | 0 | 1 |
| | 33 | 0 | 0 | 0 | 1 | 1 | 1 | 1 | 1 | 1 |
| | 34 | 1 | 1 | 1 | 1 | 0 | 0 | 1 | 1 | 1 |
| | 35 | 0 | 1 | 1 | 1 | 1 | 1 | 1 | 0 | 0 |
| | 36 | 1 | 1 | 1 | 1 | 0 | 1 | 1 | 1 | 1 |
| | 37 | 1 | 0 | 1 | 1 | 1 | 1 | 1 | 1 | 1 |
| | 38 | 1 | 1 | 1 | 1 | 1 | 1 | 0 | 1 | 1 |
| | 39 | 1 | 1 | 1 | 0 | 1 | 1 | 1 | 1 | 1 |
| | 40 | 1 | 1 | 1 | 1 | 1 | 1 | 1 | 1 | 0 |
| | 41 | 1 | 1 | 1 | 1 | 1 | 1 | 1 | 0 | 1 |
| | 42 | 1 | 1 | 0 | 1 | 1 | 1 | 1 | 1 | 1 |
| | 43 | 1 | 1 | 1 | 1 | 1 | 0 | 1 | 1 | 1 |
| | 44 | 0 | 1 | 1 | 1 | 1 | 1 | 1 | 1 | 1 |
| | 45 | 1 | 1 | 1 | 1 | 1 | 1 | 1 | 1 | 1 |

FIG. 17

30

| GRAY-SCALE LEVEL | SUB-FIELD | | | | | | | | |
|---|---|---|---|---|---|---|---|---|---|
| | sf1 | sf2 | sf3 | sf4 | sf5 | sf6 | sf7 | sf8 | sf9 |
| 0 | 0 | 0 | 0 | 0 | 0 | 0 | 0 | 0 | 0 |
| 1 | 1 | 0 | 0 | 0 | 0 | 0 | 0 | 0 | 0 |
| 2 | 0 | 0 | 1 | 0 | 0 | 0 | 0 | 0 | 0 |
| 3 | 0 | 0 | 0 | 0 | 1 | 0 | 0 | 0 | 0 |
| 4 | 0 | 0 | 0 | 0 | 0 | 0 | 1 | 0 | 0 |
| 5 | 0 | 0 | 0 | 0 | 0 | 0 | 0 | 1 | 0 |
| 6 | 0 | 0 | 0 | 0 | 0 | 1 | 0 | 0 | 0 |
| 7 | 0 | 0 | 0 | 1 | 0 | 0 | 0 | 0 | 0 |
| 8 | 0 | 1 | 0 | 0 | 0 | 0 | 0 | 0 | 0 |
| 9 | 0 | 0 | 0 | 0 | 0 | 0 | 0 | 0 | 1 |
| 10 | 1 | 0 | 0 | 0 | 0 | 0 | 0 | 0 | 1 |
| 11 | 1 | 1 | 1 | 0 | 0 | 0 | 0 | 0 | 0 |
| 12 | 0 | 0 | 1 | 1 | 1 | 0 | 0 | 0 | 0 |
| 13 | 0 | 0 | 0 | 0 | 1 | 1 | 1 | 0 | 0 |
| 14 | 0 | 0 | 0 | 0 | 0 | 0 | 0 | 1 | 1 |
| 15 | 0 | 0 | 0 | 0 | 0 | 1 | 1 | 1 | 0 |
| 16 | 0 | 0 | 0 | 1 | 1 | 1 | 0 | 0 | 0 |
| 17 | 0 | 1 | 1 | 1 | 0 | 0 | 0 | 0 | 0 |
| 18 | 1 | 0 | 0 | 0 | 0 | 0 | 0 | 1 | 1 |
| 19 | 1 | 0 | 0 | 0 | 0 | 1 | 1 | 1 | 1 |
| 20 | 1 | 1 | 1 | 0 | 0 | 0 | 0 | 0 | 1 |
| 21 | 1 | 1 | 1 | 1 | 1 | 0 | 0 | 0 | 0 |
| 22 | 0 | 0 | 1 | 1 | 1 | 1 | 1 | 0 | 0 |
| 23 | 1 | 1 | 0 | 0 | 0 | 0 | 0 | 1 | 1 |
| 24 | 0 | 0 | 0 | 0 | 0 | 1 | 1 | 1 | 1 |
| 25 | 0 | 0 | 0 | 1 | 1 | 1 | 1 | 1 | 0 |
| 26 | 0 | 1 | 1 | 1 | 1 | 1 | 0 | 0 | 0 |
| 27 | 1 | 1 | 0 | 0 | 0 | 0 | 1 | 1 | 1 |
| 28 | 1 | 0 | 0 | 0 | 1 | 1 | 1 | 1 | 1 |
| 29 | 1 | 1 | 1 | 0 | 0 | 0 | 1 | 1 | 1 |
| 30 | 1 | 1 | 1 | 1 | 1 | 0 | 0 | 0 | 0 |
| 31 | 1 | 1 | 1 | 1 | 1 | 1 | 1 | 0 | 0 |
| 32 | 1 | 1 | 1 | 1 | 0 | 0 | 0 | 1 | 1 |
| 33 | 1 | 1 | 0 | 0 | 0 | 1 | 1 | 1 | 1 |
| 34 | 0 | 0 | 0 | 1 | 1 | 1 | 1 | 1 | 1 |
| 35 | 0 | 1 | 1 | 1 | 1 | 1 | 1 | 1 | 0 |
| 36 | 0 | 0 | 1 | 1 | 1 | 1 | 1 | 1 | 1 |
| 37 | 1 | 0 | 1 | 1 | 1 | 1 | 1 | 1 | 1 |
| 38 | 1 | 1 | 1 | 0 | 1 | 1 | 1 | 1 | 1 |
| 39 | 1 | 1 | 1 | 1 | 1 | 0 | 1 | 1 | 1 |
| 40 | 1 | 1 | 1 | 1 | 1 | 1 | 1 | 0 | 1 |
| 41 | 1 | 1 | 1 | 1 | 1 | 1 | 0 | 1 | 1 |
| 42 | 1 | 1 | 1 | 1 | 0 | 1 | 1 | 1 | 1 |
| 43 | 1 | 1 | 0 | 1 | 1 | 1 | 1 | 1 | 1 |
| 44 | 0 | 1 | 1 | 1 | 1 | 1 | 1 | 1 | 1 |
| 45 | 1 | 1 | 1 | 1 | 1 | 1 | 1 | 1 | 1 |

ELECTRO-OPTICAL APPARATUS, METHOD OF DRIVING SAME, AND ELECTRONIC APPARATUS

BACKGROUND

1. Technical Field

The present invention relates to a technology for dividing one field into a plurality of sub-fields and for representing gray-scale levels by turning on or off pixels in each sub-field.

2. Related Art

When gray-scale display is to be performed in an electro-optical apparatus in which display elements such as liquid-crystal elements are used as pixels, the following technology has been proposed in place of a voltage modulation method. That is, a technology has been proposed in which one field is divided into a plurality of sub-fields, a pixel (liquid-crystal element) is turned on or off in each sub-field, and the ratio of the time period in which a pixel is turned on to the time period in which a pixel is turned off in one field is changed, thereby performing gray-scale display (see JP-A-2003-114661).

Furthermore, in the above-described technology, by using the fact that the response speed of a liquid-crystal element is comparatively slow, in more detail, by using the fact that, even if a liquid-crystal element is turned on in only one sub-field, the reflectance (or the transmittance) of the liquid-crystal element does not immediately reach a numeric value corresponding to an on state (does not saturate), the transmittance or the reflectance of the liquid-crystal element can be finely controlled.

In general, the response speed of a liquid-crystal element increases with temperature. When a state is reached in which temperature is high and the response speed of a liquid-crystal element is high, the assumption that the reflectance of the liquid crystal when the liquid-crystal element is turned on does not immediately reach a numeric value corresponding to an on state does not hold. For this reason, a problem that suitable gray-scale representation cannot be performed has been considered.

Furthermore, when the same gray scale is to be shown over a wide range of pixels, these pixels are turned on/off in the same manner, and therefore a problem of noticeable flicker has been pointed out.

SUMMARY

An advantage of some aspects of the invention is to provide an electro-optical apparatus capable of performing appropriate gray-scale representation even if response speed is changed due to temperature, in which flicker is made inconspicuous, a driving method for the electro-optical apparatus, and an electronic apparatus for use therewith.

The above-described problem results from the fact that sub-fields in which pixels are turned on or off are not consecutive. Accordingly, according to an aspect of the invention, there is provided a method for driving an electro-optical apparatus that has a plurality of pixels arranged at positions corresponding to intersections of a plurality of scanning lines and a plurality of data lines and that performs gray-scale display by applying at least an on or off voltage to each of the pixels for each of a plurality of sub-fields into which one field is divided, the method including: dividing the one field into p (p is an integer of 2 or more) groups and dividing each of the divided groups into two sub-fields; setting the p groups to have the same time period; setting time periods of sub-fields forming one field so as to be different from each other; making sub-fields to which an on or off voltage is applied be consecutive when viewed from one or adjacent fields, and setting a total of time periods of sub-fields to which an on voltage is applied over one field on the basis of a gray-scale level specified for the pixel; and dividing the plurality of scanning lines into at least first and second groups, and making a field start timing of pixels corresponding to the scanning lines of the first group differ from a field start timing of pixels corresponding to the scanning lines of the second group by at least the time period of the groups or more.

According to an aspect of the invention, the problem that pixels do not have a target brightness in the case that sub-fields in which pixels are turned on or off are not consecutive is solved. Also, even when the same gray scale is to be shown, flicker is inconspicuous because the field start timing differs between pixels corresponding to a first group of scanning lines and a second group of scanning lines.

It is preferable that a first group of scanning lines is formed as scanning lines of odd-numbered rows, a second group of scanning lines is formed as scanning lines of even-numbered rows, and field start timings of scanning lines of odd-numbered rows and adjacent scanning lines of even-numbered rows are made to differ by 180 degrees in terms of phase.

Scanning lines of odd-numbered rows and scanning lines of even-numbered rows may be alternately selected, and the duration that the scanning line of one row is selected may be set to a time period corresponding to the sub-field.

It is preferable that the pixel includes a liquid-crystal element, and the time period of the shortest sub-field among the sub-fields is set to be shorter than the saturation response time until the reflectance or the transmittance of the liquid-crystal element becomes saturated when the on voltage is applied to the liquid-crystal element. According to such a setting, since the time period of the shortest subfield is shorter than the saturation response time of the liquid-crystal element, it is possible to increase the number of representable gray-scale levels without depending on the saturation response time of the liquid-crystal element.

When viewed from one or adjacent fields, the number of gray-scale levels in which sub-fields to which an on or off voltage is applied are made consecutive is a half or more of the number of representable gray-scale levels in the pixel, display data that specifies the gray-scale level of a pixel is converted into data that specifies the application of an on or off voltage that is set for each sub-field, and an on or off voltage may be applied to the pixel on the basis of the converted data. Here, for the conversion, a conversion table may be used.

In this case, in addition to an on or off voltage, an intermediate voltage therebetween may be applied in the sub-field. As described above, when an intermediate voltage is added in addition to the two voltages of on and off, it is possible to increase the number of representable gray-scale levels without changing the arrangement of sub-fields. In this case, the number of the intermediate voltages may be two or more (slightly bright, slightly dark, etc.).

It is possible to consider the invention as a method of driving an electro-optical apparatus, the electro-optical apparatus itself, and an electronic apparatus having the electro-optical apparatus.

BRIEF DESCRIPTION OF THE DRAWINGS

The invention will be described with reference to the accompanying drawings, wherein like numbers reference like elements.

FIG. 5 shows conversion of on/off of each of sub-fields in the electro-optical apparatus.

FIG. 17 shows conversion of on/off of each sub-field in the electro-optical apparatus.

DESCRIPTION OF EXEMPLARY EMBODIMENTS

Figure 1:
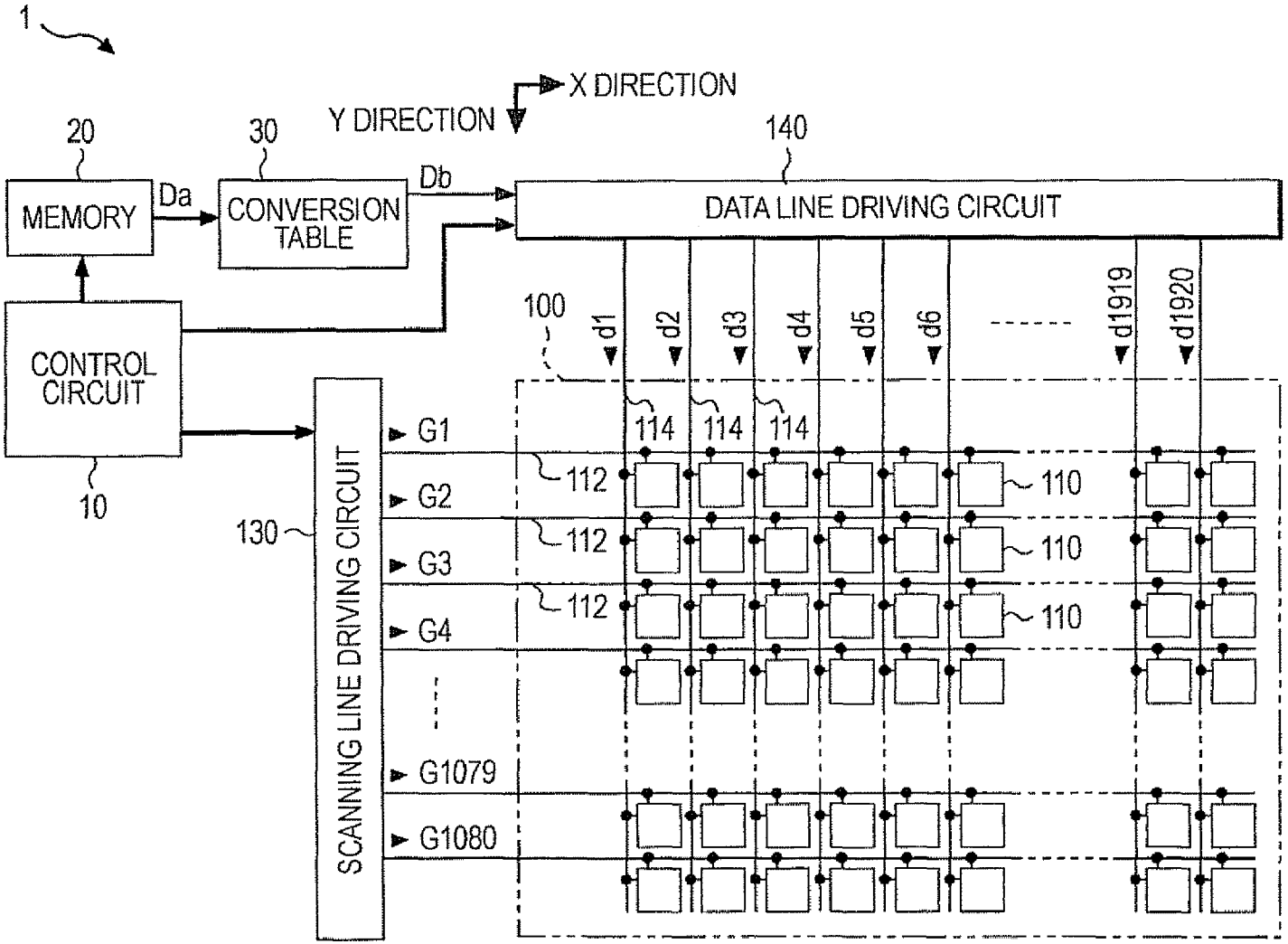
FIG. 1 shows the overall configuration of an electro-optical apparatus according to a first embodiment of the invention.

Embodiments of the invention will now be described below with reference to the drawing.

First Embodiment

A first embodiment of the invention will be described first. FIG. 1 is a block diagram showing the overall configuration of an electro-optical apparatus 1 according to the first embodiment.

As shown in FIG. 1, the electro-optical apparatus 1 broadly includes a control circuit 10, a memory 20, a conversion table 30, a display circuit 100, a scanning line driving circuit 130, and a data line driving circuit 140. The control circuit 10 controls each section, as will be described later.

In the display circuit 100, pixels are arranged in a matrix. In more detail, in the display circuit 100, scanning lines 112 of 1080 rows extend in the horizontal X direction in the figure, and data lines 114 of 1920 columns extend in the vertical Y direction in the figure while maintaining electrical insulation with the scanning lines 112. Pixels 110 are provided in such a manner as to be arranged at positions corresponding to intersections of the scanning lines 112 and the data lines 114. Therefore, in the present embodiment, the pixels 110 are arranged in a matrix of 1080 rows×1920 columns. However, the invention is not restricted to this arrangement.

The memory 20 has a storage area corresponding to the pixels arranged in 1080 rows×1920 columns. In each storage area, the display data Da of each corresponding pixel 110 is stored. The display data Da is used to specify the brightness (gray-scale level) of the pixel 110. In the present embodiment, 46 levels of brightness are specified in terms of a gray-scale level from "0" to "45" in steps of "1". Here, the gray-scale level "0" is assumed to indicate black of the lowest gray-scale level, and as the gray-scale level increases, the brightness gradually increases. The gray-scale level "45" is assumed to indicate white of the highest gray-scale level.

Whereas the display data Da is supplied from a host device (not shown) and is stored in a storage area corresponding to the pixels by the control circuit 10, data corresponding to the pixels scanned by the display circuit 100 is read from the memory 20.

Furthermore, the memory 20 stores the display data Da in at least an amount corresponding to two consecutive fields. This is because there are cases in which, as will be described later, when a voltage is written to pixels of odd-numbered rows in a certain field, in the even-numbered rows adjacent to the odd-numbered rows, a voltage is written in accordance with the display data of the preceding field.

The conversion table 30 converts the display data Da read from the memory 20 into data Db indicating which one of an on voltage and an off voltage should be applied to the pixels (liquid-crystal element) 110 on the basis of the gray-scale level specified by the display data Da and on the basis of the sub-field. The conversion content will be described later.

Configuration of Pixel

Figure 2:
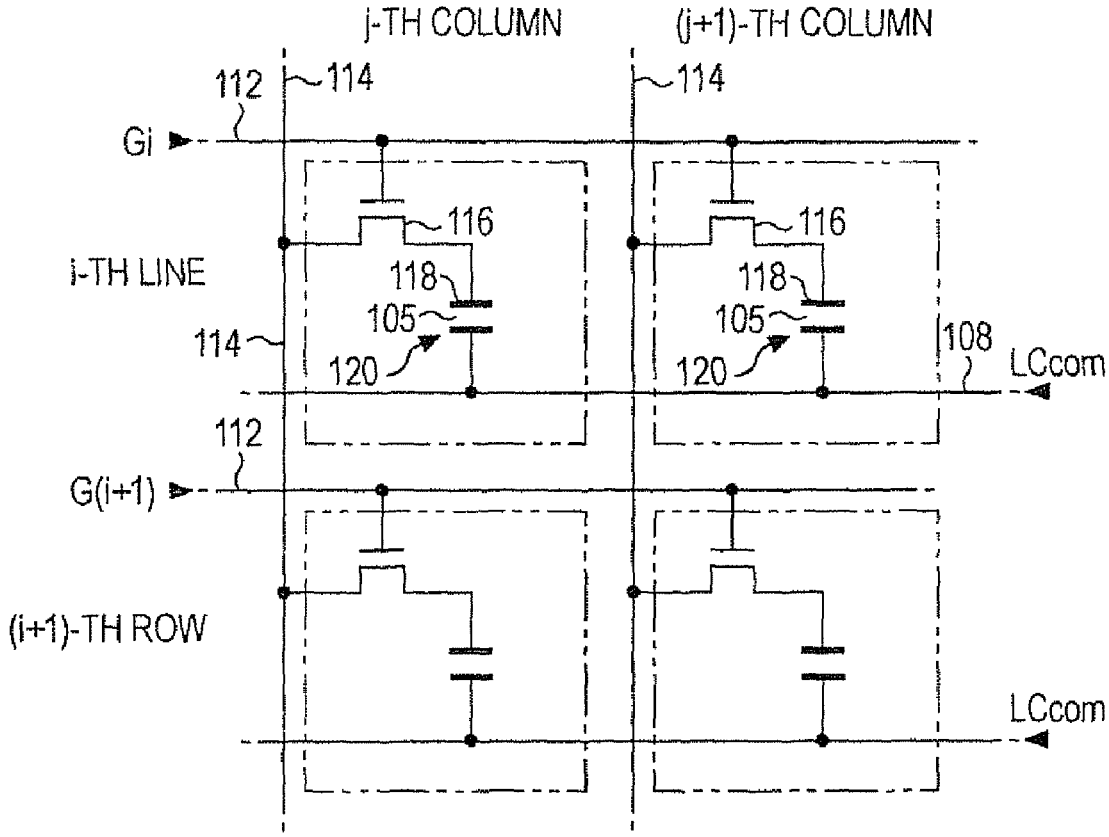
FIG. 2 shows the configuration of a pixel in the electro-optical apparatus.

For ease of description, the configuration of the pixel 110 will be described with reference to FIG. 2. FIG. 2 shows a detailed configuration of the pixel 110, also showing the configuration of a total of four pixels of 2×2 corresponding to intersections of the i-th row and the (i+1)-th row adjacent thereto, and the j-th column and the (j+1)-th column adjacent thereto. Here, i is a symbol that generally indicates an odd-numbered (1st, 3rd, 5th, 9th, . . . , 1079th) row among the 1st to 1080th rows in which the pixels 110 are arranged. (i+1) is a symbol that generally indicates an even-numbered (2nd, 4th, 6th, 8th, . . . , 1080th) row following the odd-numbered i. Furthermore, j and (j+1) are symbols that generally indicate columns in which the pixels 110 are arranged, and j is an integer from 1 to 1920.

As shown in FIG. 2, each pixel 110 includes an n-channel type transistor (MOS-type FET) 116 and a liquid-crystal element 120.

Here, the pixels 110 have the same configuration, and accordingly, the pixel positioned at the i-th row and the j-th column will be described as a representative pixel. The gate electrode of the transistor in the pixel 110 positioned at the i-th row and the j-th column is connected to the scanning line 112 of the i-th row, whereas the source electrode thereof is connected to the data line 114 of the j-th column and the drain electrode thereof is connected to a pixel electrode 118, which is one end of the liquid-crystal element 120. The other end of the liquid-crystal element 120 is a counter electrode 108. The counter electrode 108 is common to all the pixels 110 and is maintained at a voltage LCcom in the present embodiment.

The display circuit 100 is configured in such a manner that an element substrate on which the scanning lines 112, the data lines 114, the transistor 116, the pixel electrodes 118, and the like are formed, and a counter substrate on which the counter electrode 108 is formed are laminated so that the electrode-formed surfaces face each other with a fixed space in between, and liquid crystal 105 is sealed in the space. For this reason, in the present embodiment, the liquid-crystal element 120 is configured in such a manner that the liquid crystal 105 is held between the pixel electrode 118 and the counter electrode 108.

In the present embodiment, a semiconductor substrate is used for the element substrate, and a transparent substrate, such as glass, is used for the counter substrate, so as to be formed as an LCOS (Liquid Crystal on Silicon)-type in which the liquid-crystal element 120 is of a reflection type. For this reason, the element substrate may also be configured in such a manner that, in addition to the scanning line driving circuit 130 and the data line driving circuit 140, all of the control circuit 10, the memory 20, and the conversion table 30 are formed.

In this configuration, when a selection voltage Vdd corresponding to an H level is applied to the scanning line 112 so as to cause the transistor 116 to be turned on (brought into conduction), and a data signal is supplied to the pixel electrode 118 via the data line 114 and the transistor 116 in an on state, a differential voltage between the voltage of the data signal and a voltage LCcom applied to the counter electrode 108 is written to the liquid-crystal element 120 corresponding to the intersection of the scanning line 112 to which the selection voltage is applied and the data line 114 to which the data signal is supplied. When the scanning line 112 is set to a non-selection voltage (ground electric potential Gnd) corresponding to an L level, the transistor 116 enters an off (non-conduction) state. In the liquid-crystal element 120, the differential voltage written when the transistor 116 enters a conductive state is held due to the capacitive property thereof.

In the present embodiment, the liquid-crystal element 120 is set to a normally black mode. For this reason, the reflectance (the transmittance in the case of a transmissive type) of the liquid-crystal element 120 decreases as the effective value of the differential voltage between the pixel electrode 118 and the counter electrode 108 decreases, and the liquid-crystal element 120 becomes almost black in a voltage non-application state.

However, in the present embodiment, only one of a voltage that makes the differential voltage be an on voltage of a saturated voltage or higher and a voltage that makes the differential voltage be an off voltage of a threshold voltage or lower is applied to the pixel electrode 118.

In the normally black mode, when the reflectance in the darkest state is set as a relative reflectance 0% and the reflectance in the brightest state is set as a relative reflectance 100%, among voltages applied to the liquid-crystal element 120, the voltage at which the relative reflectance becomes 10% is called an optical threshold voltage, and the voltage at which the relative reflectance becomes 90% is called an optical saturated voltage. In the voltage modulation method (analog driving), when the liquid-crystal element 120 is made to display a half-tone (gray), a design is made so that a voltage of the optical saturated voltage or lower is applied to the liquid crystal 105. For this reason, the reflectance of the liquid crystal 105 becomes a value that is nearly proportional to the applied voltage of the liquid crystal 105.

In comparison, in the present embodiment, only one of an on voltage and an off voltage is applied to the liquid-crystal element 120, and gray-scale display is performed in the following manner. In more detail, the gray-scale display in the present embodiment is performed in such a way that one field is divided into a plurality of sub-fields, the period in which an on voltage is applied to the liquid-crystal element 120 and the period in which an off voltage is applied thereto are allocated in units of sub-fields and controlled.

In the present embodiment, for an on voltage, a differential voltage that is about 1 to 1.5 times as high as the saturation voltage is used. The reason for this is that, since the rise of the liquid crystal in the response characteristics is nearly in proportion to a voltage level applied to the liquid-crystal element, the differential voltage is preferable in order to improve the response characteristics of the liquid crystal.

Furthermore, for an off voltage, a differential voltage that is an optical threshold voltage or lower is used.

The actual reflectance of the liquid-crystal element is approximately proportional to the integration value of the period in which the on voltage is applied due to the response of the liquid crystal. For the simplification of description, there is a case in which a description is given by assuming that the actual reflectance of the liquid-crystal element is proportional to the period in which an on voltage is applied.

Structure of Field

As described above, in the present embodiment, gray-scale display is performed by allocating and controlling the period in which an on or off voltage is applied to the liquid-crystal element 120 and held in units of sub-fields. Accordingly, next, the structure of fields in the present embodiment will be described.

Figure 3A:
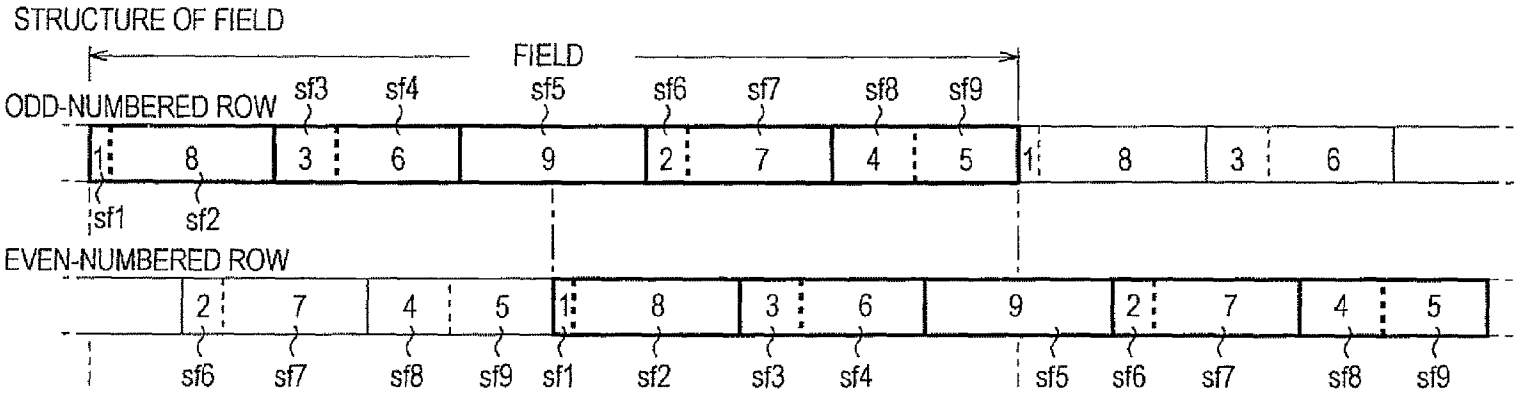
FIGS. 3A and 3B show the structure of fields, and the like in the electro-optical apparatus.

FIG. 3A shows the structure of fields.

As shown in FIG. 3A, in the present embodiment, the structure of fields of odd-numbered rows and even-numbered rows is the same with regard to the order of sub-field numbers with respect to time. However, with respect to a field of an odd-numbered i-th row, the field of the even-numbered (i+1)-th row is delayed by ½ fields, that is, by 180 degrees, in terms of phase.

One field corresponds to a period required to form one image, is fixed and has a constant period of 16.7 milliseconds (corresponding to one cycle of a frequency of 60 Hz), and is synonymous with a frame in a non-interlaced method.

In the present embodiment, one field is equally divided into five groups in both the odd-numbered and even-numbered rows. Among them, the first, second, fourth, and fifth groups, excluding the third group, are divided into two portions, and these are formed as nine sub-fields. For the sake of convenience, when sub-fields into which one field is divided by using odd-numbered rows as a reference are denoted in sequence as sf1, sf2, sf3, . . . , sf9, the sub-fields sf1 and sf2 form one group. Similarly, sf3 and sf4, sf6 and sf7, and sf8 and sf9 each form a group. The sub-field sf5 singly forms one group.

Here, when the time period of the shortest subfield sf1 is set to "1" as a ratio, the ratio of the time period of one group is "9", and the ratio of the period of one field is "45", which is 5 times as that. The ratios of the time periods of the sub-fields sf2, sf3, sf4, sf5, sf6, sf7, sf8, and sf9 are "8", "3", "6", "9", "2", "7", "4", and "5", respectively.

Since the fields are consecutive when viewed with respect to time, the sub-field sf9 of a certain field is adjacent to the sub-field sf1 of the next field.

The field of the even-numbered (i+1)-th row with respect to the field of the odd-numbered i-th row is shifted by ½ fields. Therefore, for example, when an odd-numbered i-th row is at a start timing of the sub-field sf1 in a certain field, the even-numbered (i+1)-th row is at a timing in the middle of the sub-field sf5 in the preceding field.

Gray-Scale Display

Figure 4:
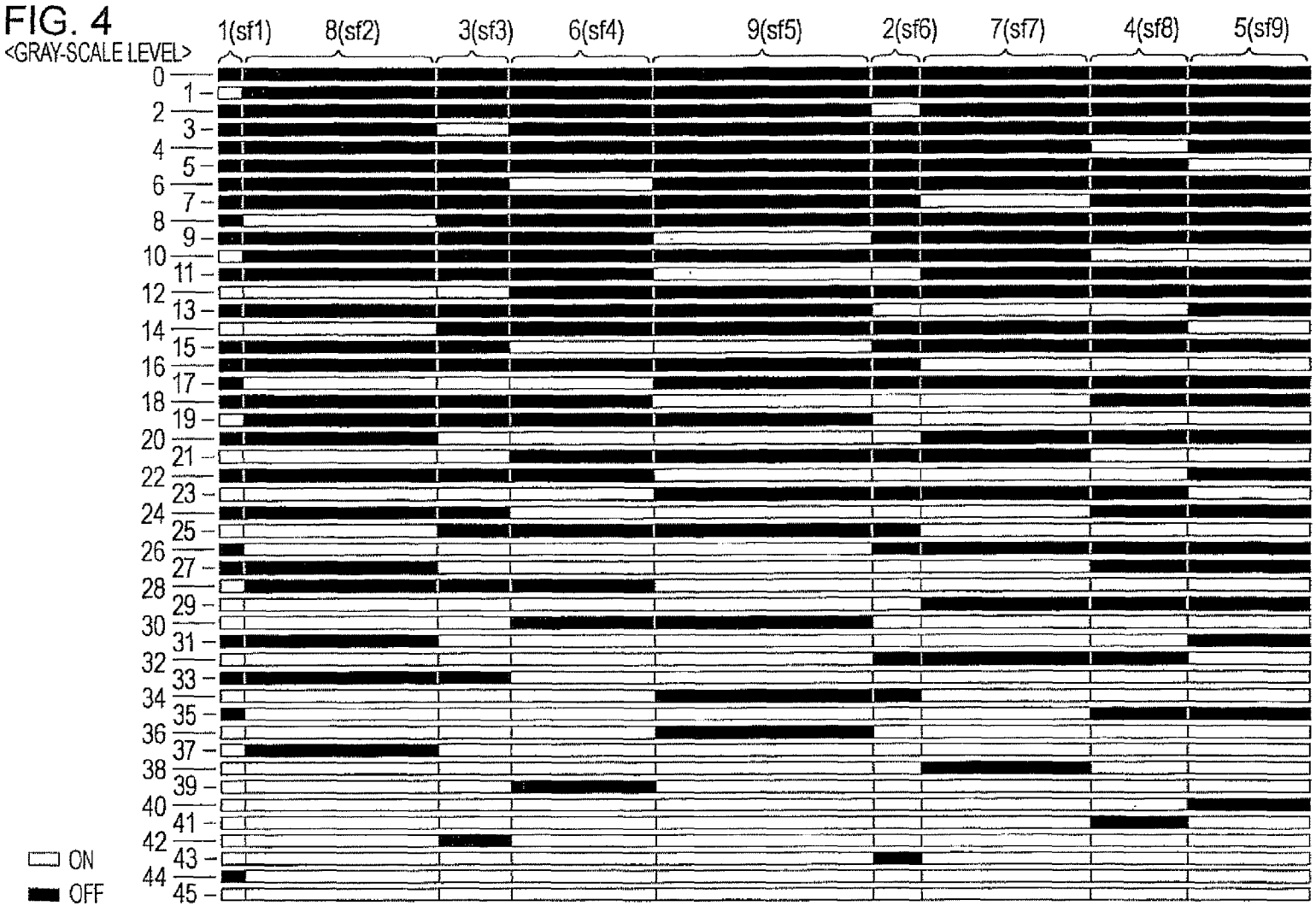
FIG. 4 shows a gray-scale display by the electro-optical apparatus.

Next, a description will be given below of how an on or off voltage is applied to sub-fields sf1 to sf9 constituting a field in order to perform gray-scale display. FIG. 4 shows the allocation of application of an on or off voltage to the sub-fields sf1 to sf9 for each of the gray-scale levels "0" to "45". In the present embodiment, it is assumed that the gray-scale level "0" corresponds to black at the lowest grayscale, brightness gradually increases as the gray-scale level increases, and the gray-scale level "45" specifies the highest grayscale.

The horizontal direction of □ and ■ corresponding to each sub-field corresponds to the time period of each corresponding sub-field. □ indicates that an on voltage is applied to the liquid-crystal element 120, and ■ indicates that an off voltage is applied to the liquid-crystal element 120.

In the present embodiment, since the liquid-crystal element 120 has been set to the normally black mode in the manner described above, if the gray-scale level is the lowest "0", when an off voltage is applied to the liquid-crystal elements 120 over the entirety of the sub-fields sf1 to sf9, a black display of the lowest grayscale is made when one field is viewed as a unit time.

Next, from the time when the gray-scale level is "1" to the time when it is "8", an on voltage is applied in sequence to the liquid-crystal element 120 on only each of the sub-fields sf1, sf6, sf3, sf8, sf9, sf4, sf7, and sf2, respectively.

Here, when the ratio of the period in which an on voltage is applied to the liquid-crystal element 120 in one field is expressed using a fraction in which the numerator is set to be a ratio of the period in which an on voltage is applied and the denominator is set to be a ratio "45" of the period of one field, the ratios of the periods in which an on voltage is applied in the gray-scale levels "1" to "8" are 1/45, 2/45, 3/45, 4/45, 5/45, 6/45, 7/45, and 8/45, respectively.

Here, when the gray-scale level is, for example, "13", simply, the ratio of the application period of the on voltage to the liquid-crystal element 120 needs only be set to 13/45. Therefore, a configuration can be considered in which, for example, an on voltage is applied to the liquid-crystal element 120 over the sub-field sf4 whose ratio of the time period is "6" and the sub-field sf7 whose ratio of the time period is "7", and an off voltage is applied to the other sub-fields.

However, in this structure, it is necessary to have characteristics of an electro-optical response close to an ideal such that the liquid-crystal element 120 makes a black (or white) display at the moment an on voltage (or an off voltage) is applied to the liquid-crystal element 120. The liquid-crystal element 120 has characteristics such that the characteristics of an electro-optical response are comparatively poor, and even when an on voltage (or an off voltage) is applied, the reflectance does not immediately saturate, and the liquid-crystal element 120 gradually approaches black or white.

For this reason, when sub-fields to which an on voltage is applied are not consecutive, in the liquid-crystal element 120, before a sufficient black color is reached in the sub-field in which an on voltage is applied, the process shifts to a sub-field in which an off voltage is applied, and thereafter, the process shifts again to a sub-field in which an on voltage is applied. As a consequence, in each sub-field, an expected black or white display is not made, and the possibility of being incapable of obtaining an appropriate gray-scale display when viewed from one field is high. In particular, in the liquid-crystal element 120, electro-optical response characteristics greatly change depending on the ambient temperature, and therefore, it is considered that the gray scale becomes likely to deviate from the target gray scale with respect to temperature change.

Accordingly, in the present embodiment, the construction is formed in such a way that sub-fields in which an on/off voltage is applied at each gray-scale level are made consecutive.

In the present embodiment, as described above, the ratio of the time period of each group is set to "9". This means that, when a certain sub-field is considered, a group whose ratio of the time period is "9" always exists in either the forward direction or the backward direction with respect to time in regard to the subfield of interest.

Therefore, regarding the gray-scale levels "10" to "17", an on voltage is applied to the liquid-crystal element over the "fractional sub-field" and the group positioned in the forward direction or the backward direction with respect to time in regard to the fractional sub-field.

Here, when an integer from 10 to 17 is denoted as P, the "fractional sub-field" regarding the gray-scale level P refers to a sub-field in which the ratio of the time period is (P-9).

For example, regarding the gray-scale level "10", the "fractional sub-field" is a sub-field sf1 in which the ratio of the time period is "1". For this reason, in the gray-scale level "10", an on voltage is applied to the liquid-crystal element 120 over the sub-field sf1, which is a "fractional sub-field", and a group positioned in the forward direction with respect to time in regard to the sub-field sf1 (a group of sub-fields sf8/sf9 in the preceding field).

As a result, sub-fields in which an on voltage is applied to the liquid-crystal element 120 having a gray-scale level "10", are sf1, sf8, and sf9, and the ratio of the sum of the time periods is 10/45. Furthermore, the sub-fields sf1, sf8, and sf9 are consecutive when viewed from adjacent fields, and also the subfields sf2 to sf7, which are made off, are consecutive.

Similarly, regarding the gray-scale level "11 (12, 13)", an on voltage is applied to the liquid-crystal element 120 over the sub-field sf6 (sf3, sf8) in which the ratio of the time period is "2" ("3", "4"), and a group of sub-field sf5 (sf1/sf2, sf6/sf7) positioned in the forward direction with respect to time in regard to the sub-field.

Next, regarding the gray-scale level "14", an on voltage is applied to the liquid-crystal element 120 over the sub-field sf9 in which the ratio of the time period is "5", and a group of sub-fields sf1/sf2 positioned in the backward direction with respect to time in regard to the sub-field.

Similarly, regarding the gray-scale level "15 (16, 17)", an on voltage is applied to the liquid-crystal element 120 over the sub-field sf4 (sf7, sf2) in which the ratio of the time period is "6" ("7", "8"), and a group of sub-field sf5 (sf8/sf9, sf3/sf4) positioned in the backward direction with respect to time in regard to the sub-field.

Next, regarding the gray-scale levels "19", to "26", an on voltage is applied to the liquid-crystal element over a "fractional sub-field" and two consecutive groups, which are positioned in the forward or backward direction with respect to time in regard to the sub-field. Here, when an integer from 19 to 26 is denoted as Q, the "fractional sub-field" regarding the gray-scale level Q refers to a sub-field in which the ratio of the time period is (Q-18).

For example, regarding the gray-scale level "19", the "fractional sub-field" is the sub-field sf1 in which the ratio of the time period is "1". For this reason, at the gray-scale level "19", an on voltage is applied to the liquid-crystal element 120 over the sub-field sf1 that is a "fractional sub-field" and two consecutive groups in the backward direction with respect to time in regard to the sub-field sf1 (a group of sub-fields sf6/sf7 in the preceding field, and a group of sub-fields sf8/sf9).

As a result, the sub-fields in which an on voltage is applied to the liquid-crystal element 120 having a gray-scale level "19" are Sf1, sf6, sf7, sf8, and sf9, and the ratio of the sum of the time periods is 19/45. Furthermore, the sub-fields sf1, sf6, sf7, sf8, and sf9 are consecutive when viewed from adjacent fields, and the sub-fields sf2 to sf5, which are made off, are consecutive.

Similarly, regarding the gray-scale level "20 (21, 22)", an on voltage is applied to the liquid-crystal element 120 over the sub-field sf6 (sf3, sf8) in which the ratio of the time period is "2", ("3", "4"), and two groups of sub-fields sf3/sf4 and sf5 that are consecutive in the forward direction with respect to time in regard to the sub-field (two groups of sf8/sf9 and sf1/sf2 and two groups of sf5 and sf6/sf7).

Next, regarding the gray-scale level "23", an on voltage is applied to the liquid-crystal element 120 over the sub-field sf9 in which the ratio of the time period is "5", and two groups of sub-fields sf1/sf2 and sf3/sf4 that are consecutive in the backward direction with respect to time in regard to the sub-field.

Similarly, regarding the gray-scale level "24 (25, 26)", an on voltage is applied to the liquid-crystal element 120 over the sub-field sf4 (sf7, sf2) in which the ratio of the time period is "6" ("7", "8"), and two groups of sub-fields sf5 and sf6/sf7 that are consecutive in the backward direction with respect to time in regard to the sub-field (two groups of sf8/sf9 and sf1/sf2 and two groups of sf3/sf4 and sf5).

Next, regarding the gray-scale levels "28" to "35", an on voltage is applied to the liquid-crystal element over a "fractional sub-field" and three groups that are consecutive in the forward or backward direction with respect to time in regard to the sub-field. Here, when an integer of 28 to 35 is denoted as R, the "fractional sub-field" regarding the gray-scale level R refers to a sub-field in which the ratio of the time period is (R-27).

For example, regarding the gray-scale level "28", the "fractional sub-field" is the sub-field sf1 in which the ratio of the time period is "1". For this reason, in the gray-scale level "28", an on voltage is applied to the liquid-crystal element 120 over the sub-field sf1 that is a "fractional sub-field" and three groups that are consecutive in the forward direction with respect to time in regard to the sub-field sf1 (a group of sub-field sf5 in the preceding field, a group of subfields sf6/sf7, and a group of sub-fields sf8/sf9).

As a result, the sub-fields in which an on voltage is applied to the liquid-crystal element 120 having a gray-scale level "28" are sf1, sf5, sf6, sf7, sf8, and sf9, and the ratio of the sum of the time periods becomes 28/45. Furthermore, the sub-fields sf1, sf5, sf6, sf7, sf8, and sf9 are consecutive when viewed from adjacent fields, and the sub-fields sf2 to sf4, which are made off, are consecutive.

Similarly, regarding the gray-scale level "29 (30, 31)", an on voltage is applied to the liquid-crystal element 120 over the sub-field sf6 (sf3, sf8) in which the ratio of the time period is "2" ("3", "4"), and three groups of sub-fields sf1/sf2, sf3/sf4, and sf5 that are consecutive in the forward direction with respect to time in regard to the sub-field (three groups of sf6/sf7, sf8/sf9, and sf1/sf2, three groups of sf3/sf4, sf5, and sf6/sf7).

Next, regarding the gray-scale level "32", an on voltage is applied to the liquid-crystal element 120 over the sub-field sf9 in which the ratio of the time period is "5", and three groups of sub-fields sf1/sf2, sf3/sf4, and sf5 that are consecutive in the backward direction with respect to time in regard to the sub-field.

Similarly, regarding the gray-scale level "33 (34, 35)", an on voltage is applied to the liquid-crystal element 120 over the sub-field sf4 (sf7, sf2) in which the ratio of the time period is "6" ("7", "8"), and three groups of sub-fields sf5, sf6/sf7, and sf8/sf9 that are consecutive in the backward direction with respect to time in regard to the sub-field (three groups of sf8/sf9, sf1/sf2, and sf3/sf4, and three groups of sf3/sf4, sf5, and sf6/sf7).

When the gray-scale level is from "37" to "44", an off voltage is applied to the liquid-crystal element 120 in only each of the sub-fields sf2, sf7, sf4, sf9, sf8, sf3, sf6, and sf1 in sequence. Then, if the gray-scale level is a maximum "45", an on voltage is applied to the liquid-crystal element 120 over the entirety of the sub-fields sf1 to sf9.

Furthermore, if the gray-scale level is "9", an on voltage needs only be applied to the liquid-crystal element 120 over sub-fields constituting any one of the groups. For this reason, in the present embodiment, regarding the gray-scale level "9", an on voltage is applied over the sub-field sf5. Similarly, when the gray-scale level is "18 (27, 36)", an on voltage needs only be applied to the liquid-crystal element 120 over the sub-fields of two consecutive groups (three groups, four groups). For this reason, regarding the gray-scale level "18 (27, 36)", an on voltage is applied to the liquid-crystal element 120 over, for example, two groups of sub-fields sf5 and sf6/sf7 (three groups of sub-fields sf3/sf4, sf5, and sf6/sf7, four groups of sub-fields sf6/sf7, sf8/sf9, sf1/sf2, and sf3/sf4).

As described above, in the present embodiment, gray-scale representation of a total of 46 steps in steps of "1" from the gray-scale level "0" to "45" is possible. At 26 steps from the gray-scale level of "10" to "35" among them, both the sub-fields that are turned on and off when viewed from one field or adjacent fields are consecutive.

Regarding the other gray-scale levels "0" to "8" and "36" to "45", the number of the sub-fields denoting one of on and off is "0" or "1". As a consequence, only the sub-fields denoting the other of on or off are consecutive.

Regarding the gray-scale level "9", an on voltage is applied in only the sub-field sf5. However, as described above, an on voltage may be applied continuously over, for example, the sub-fields sf6/sf7.

As described above, in the present embodiment, after the time periods of the sub-fields sf1 to sf9 are made to differ from one another, while sub-fields in which an on/off voltage is applied are made to be consecutive, sub-fields in which an on or off voltage is applied in the above-described procedure are specified. As a consequence, difficulty is not incurred in the combination of sub-fields that are turned on/off.

Conversion Using Conversion Table

Next, the conversion using the conversion table 30 used to perform such a gray-scale display will be described with reference to FIG. 5.

As shown in FIG. 5, in the conversion table 30, a gray-scale level specified using display data Da read from the memory 20 is converted, for each of the sub-fields sf1 to sf9, into data Db that specifies an application of an on or off voltage to the liquid-crystal element 120. In FIG. 5, "1" indicates that an on voltage is applied to the liquid-crystal element 120, and "0" indicates that an off voltage is applied to the liquid-crystal element 120. For example, when the gray-scale level is "13", it is specified that, in the sub-fields sf5 to sf7, an on voltage is applied to the liquid-crystal element 120, and in the other sub-fields, an off voltage is applied to the liquid-crystal element 120. By specifying which one of the on and off voltages is applied to the liquid-crystal element in accordance with the data Db by using the conversion table, the gray-scale display shown in FIG. 4 is realized.

In FIG. 5, hatched "1s" in the gray-scale levels "10" to "17", "19" to "26", and "28", to "35" indicate "fractional sub-fields" described above, Scanning Line Driving Circuit FIG. 6 is a block diagram showing the configuration of the scanning line driving circuit 130 in the present embodiment.

Figure 6:
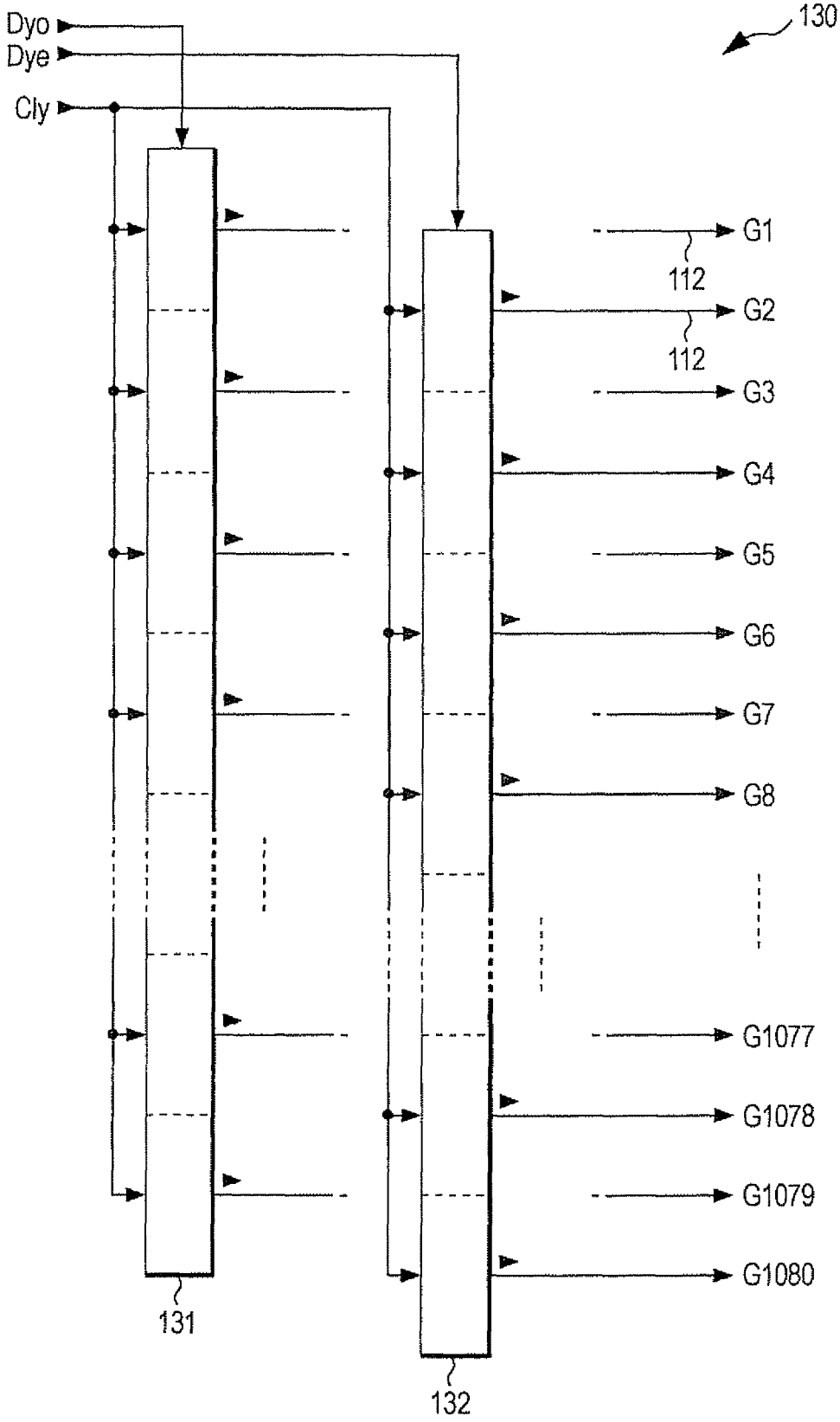
FIG. 6 shows the configuration of a scanning line driving circuit in the electro-optical apparatus.

As shown in FIG. 6, the scanning line driving circuit 130 includes two shift registers 131 and 132. The shift register 131 drives scanning lines 112 of odd-numbered rows, and has unit circuits of 540 stages corresponding to half of 1080 rows. On the other hand, the shift register 132 drives scanning lines 112 of even-numbered rows, and has unit circuits of 540 stages in a similar manner.

The unit circuit at each stage in the shift registers 131 and 132 sequentially delays an input signal by an amount corresponding to one cycle of a clock signal Cly and outputs the signal as a scanning signal and also, supplies the signal as an input signal to the unit circuit at the next stage.

Here, the scanning signals output from the unit circuits at the 1st, 2nd, 3rd, 4th, . . . , 539th, 540th stages in the shift register 131 are supplied, as G1, G3, G5, G7, . . . , G01077, G1079, to the scanning lines 112 of the 1st, 3rd, 5th, 7th . . . , 1077th, 1079th rows, which are odd-numbered rows, respectively. Similarly, the scanning signals output from the unit circuits of the 1st, 2nd, 3rd, 4th, . . . , 539th, 540th stages in the shift register 132 are supplied, as G2, G4, G6, G8, . . . , G1078, G1080, to the scanning lines 112 of the 2nd, 4th, 6th, 8th . . . , 1078th, 1080th rows, which are even-numbered rows, respectively.

The input signal of the unit circuit at the first stage in the shift register 131 is a start pulse Dyo, and the input signal of the unit circuit at the first stage in the shift register 132 is a start pulse Dye.

The clock signal Cly and the start pulses Dyo and Dye are each supplied from the control circuit 10. The duty ratio of the clock signal Cly is 50%. When one cycle of the clock signal Cly is denoted as H and the time period is indicated using a multiple of H, the time period of one group in the present embodiment is set to 1080H, which is 1080 times as long as that of the clock signal Cly, and the time period of one field is set to 5400H, which is 5 times as that.

Figure 3B:
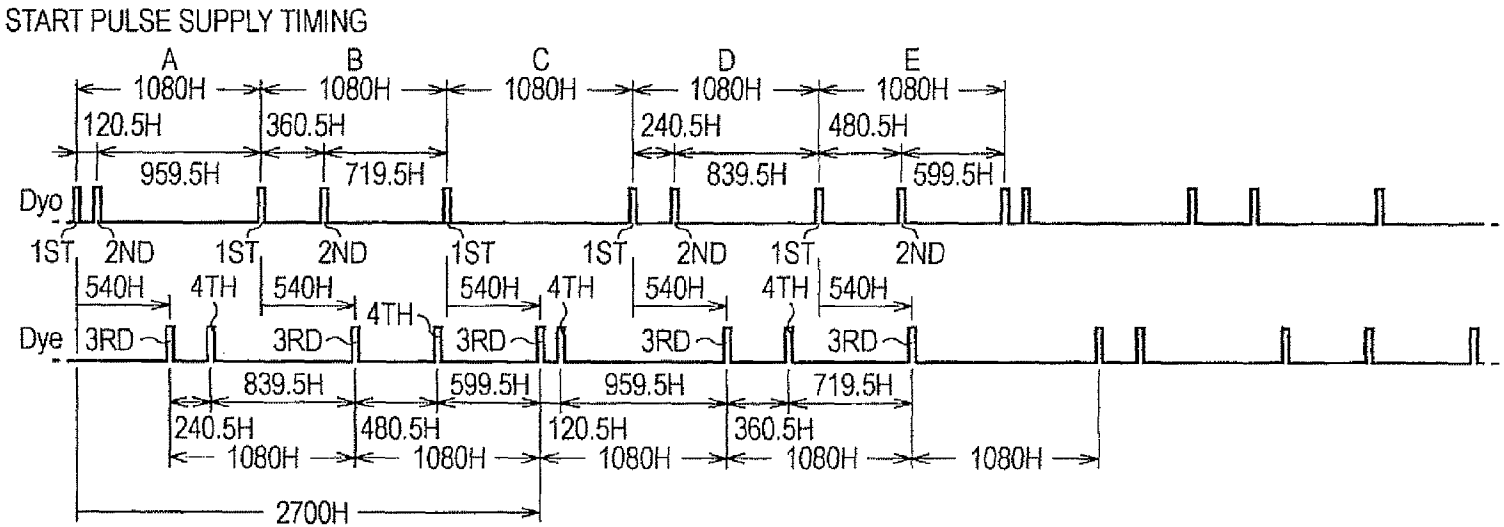

The start pulses Dyo and Dye are each a pulse signal that reaches an H level at a width corresponding to the half cycle of the clock signal Cly, and are each output as shown in FIG. 3B.

More specifically, the start pulse Dyo includes a pulse (for the sake of convenience, referred to as a first pulse) that is output at equal intervals every 1080H of the clock signal Cly at the start timings of the periods A, B, C, D, and E in which the period of one field is divided into five portions, and a pulse (similarly sometimes referred to as a second pulse) that is delayed by 120.5 W, 360.5H, 240.5H, and 480.5H with respect to the first pulse output at the start timings of the periods A, B, D, and B, excluding the period C, within the first pulse output at equal intervals, respectively.

In the present embodiment, the first pulse at the start timings of the periods A, B, C, D, and E within the start pulses Dyo is output when the clock signal Cly is at an H level. The second pulse other than those has been delayed by 120.5H, 360.5 W, 240.5H, and 480.5H from the start timings of the periods A, B, D, and B, respectively. Therefore, the second pulse is output when the clock signal Cly is at an L level.

On the other hand, the start pulse Dye is delayed by 2700H corresponding to ½ fields with respect to the start pulse Dyo, and is output.

Therefore, the start pulse Dye includes a third pulse, which is output at equal intervals as a result of each of them being delayed by 540H from the first pulse of the start pulse Dyo output at the start timings of the periods A, B, C, D, and E, and a fourth pulse, which is delayed by 240.5H, 480.5H, 120.5H, and 360.5H from the third pulse output at the periods A, B, C, and D, respectively, excluding the period E, within the third pulse.

In the present embodiment, the third pulse output at equal intervals within the start pulse Dye is delayed by 540H from the first pulse, and therefore is output when the clock signal Cly is at an H level. The fourth pulse other than those has been delayed by 240.5H, 480.5H, 120.5H, and 360.5H with respect to the third pulse output at periods A, B, C, and D, respectively, and therefore, is output when the clock signal Cly is at an L level.

Figure 7:
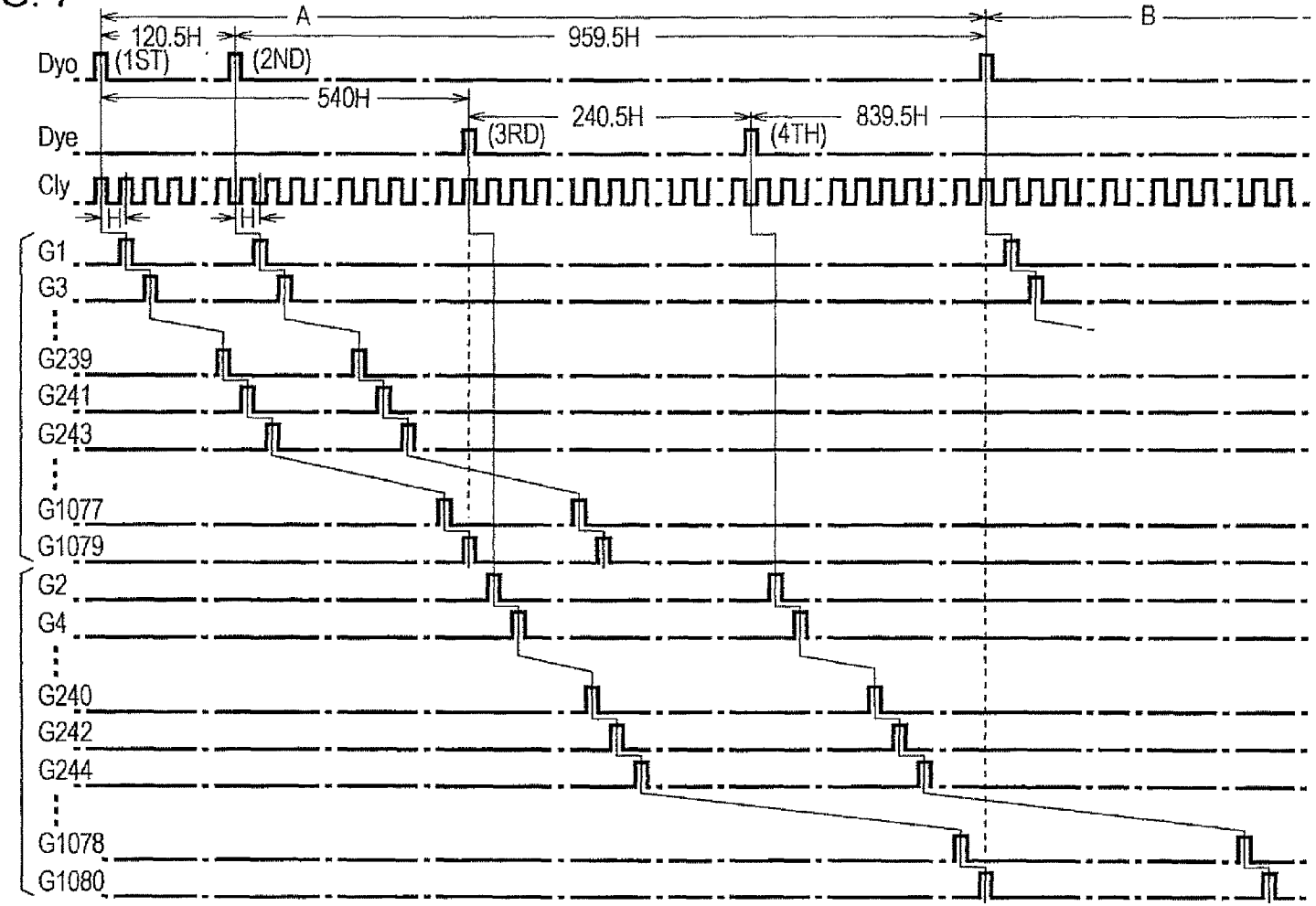
FIG. 7 is a timing chart showing the operation of the scanning line driving circuit.
Figure 8:
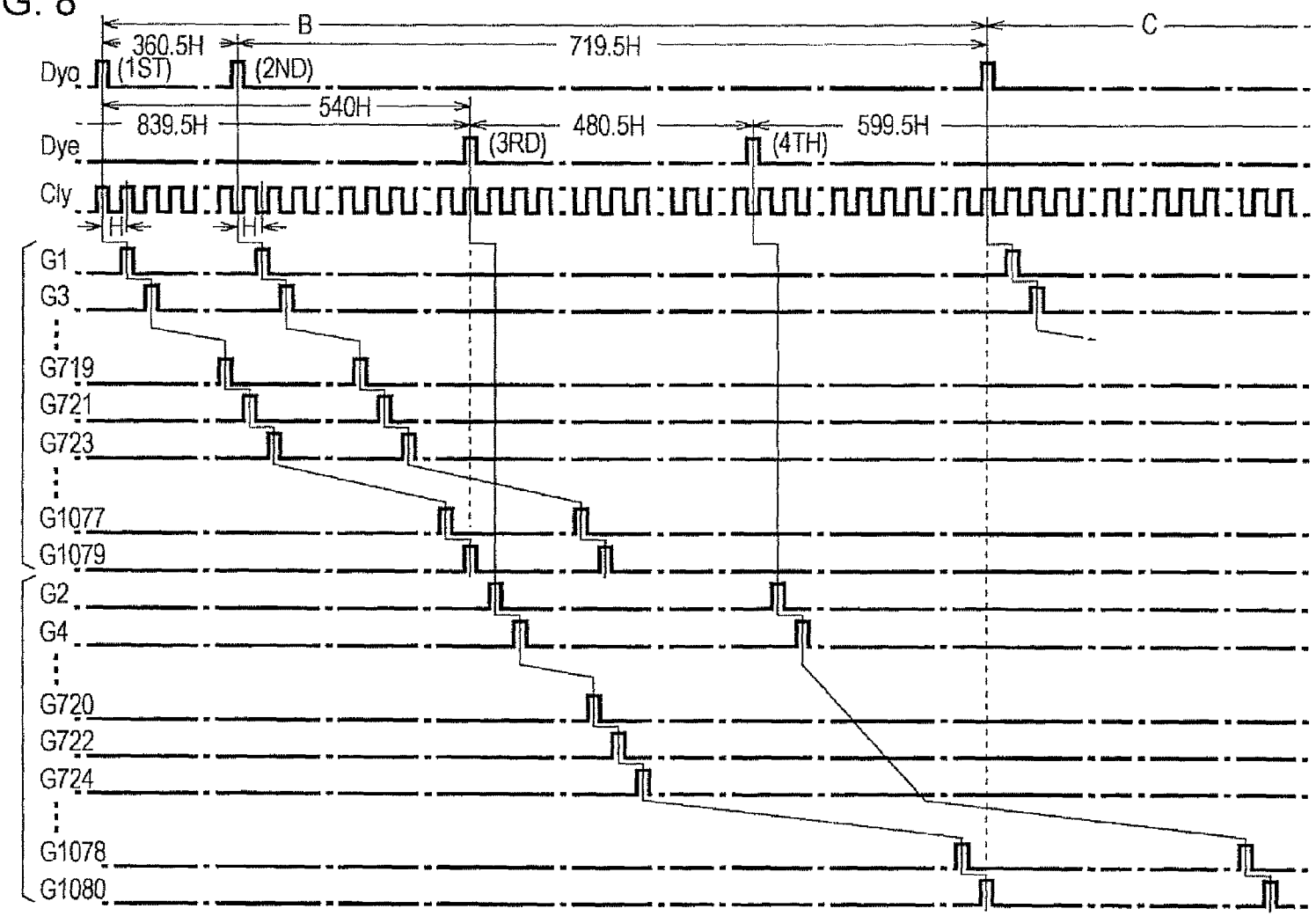
FIG. 8 is a timing chart showing the operation of the scanning line driving circuit.
Figure 9:
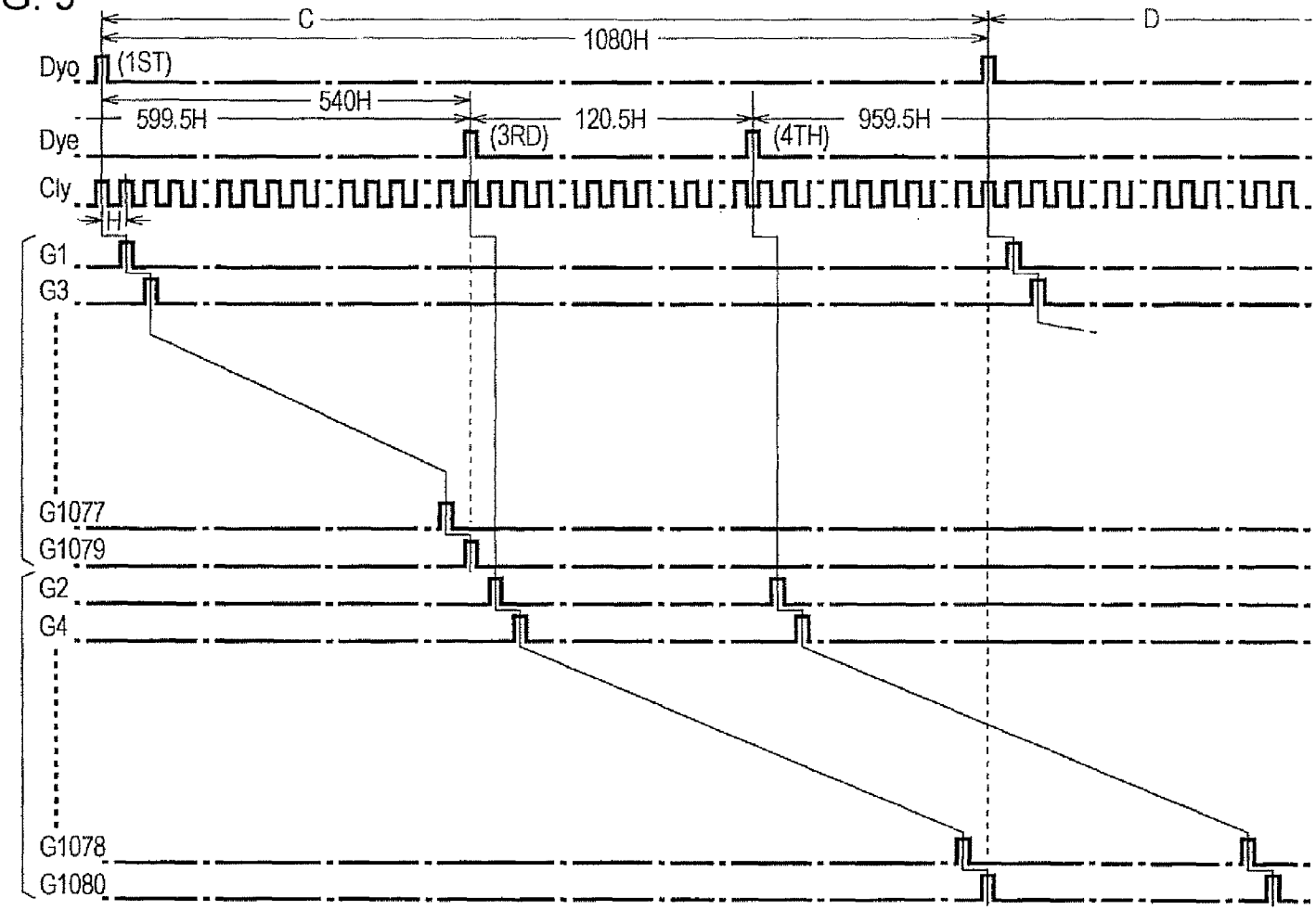
FIG. 9 is a timing chart showing the operation of the scanning line driving circuit.
Figure 10:
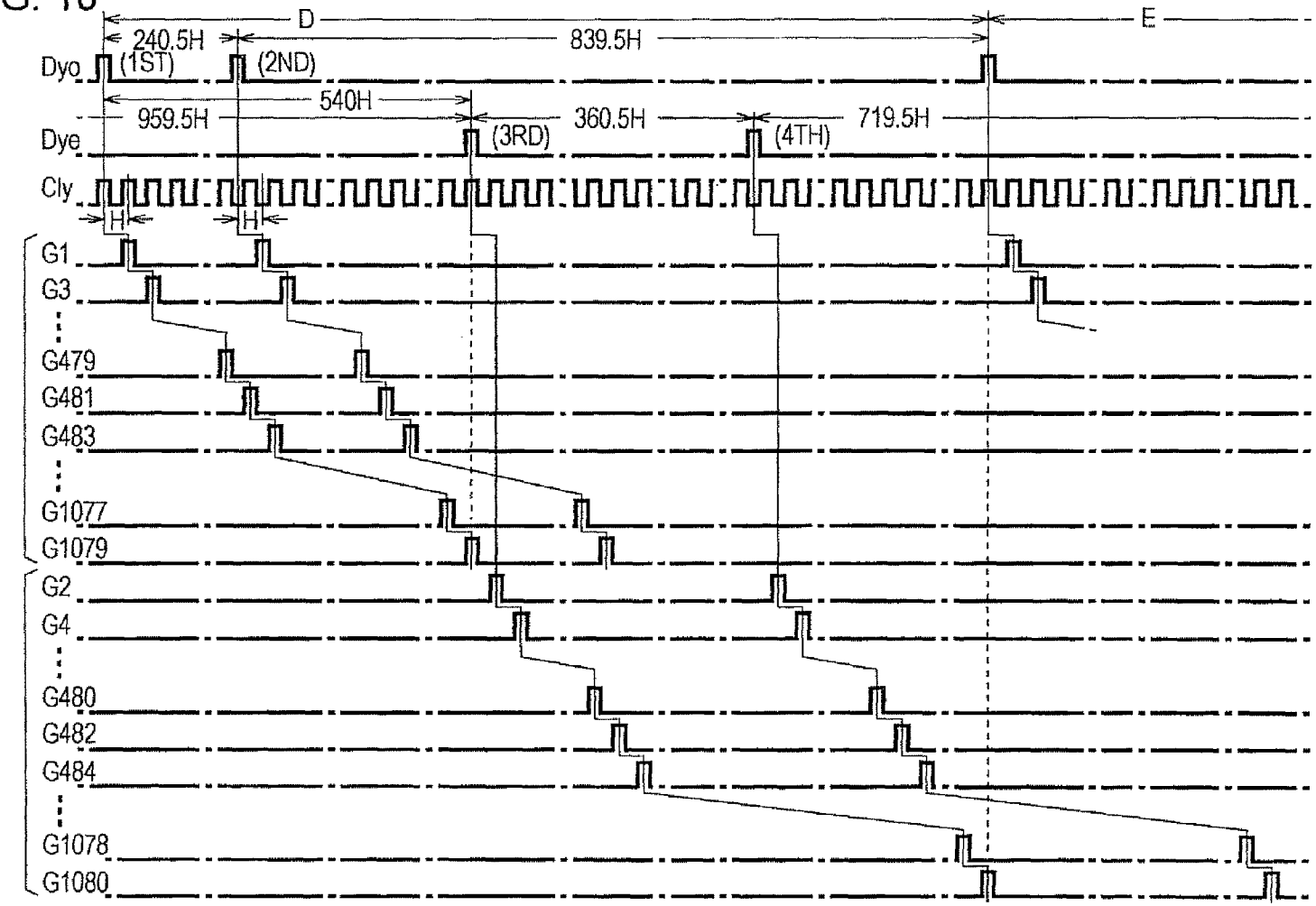
FIG. 10 is a timing chart showing the operation of the scanning line driving circuit.
Figure 11:
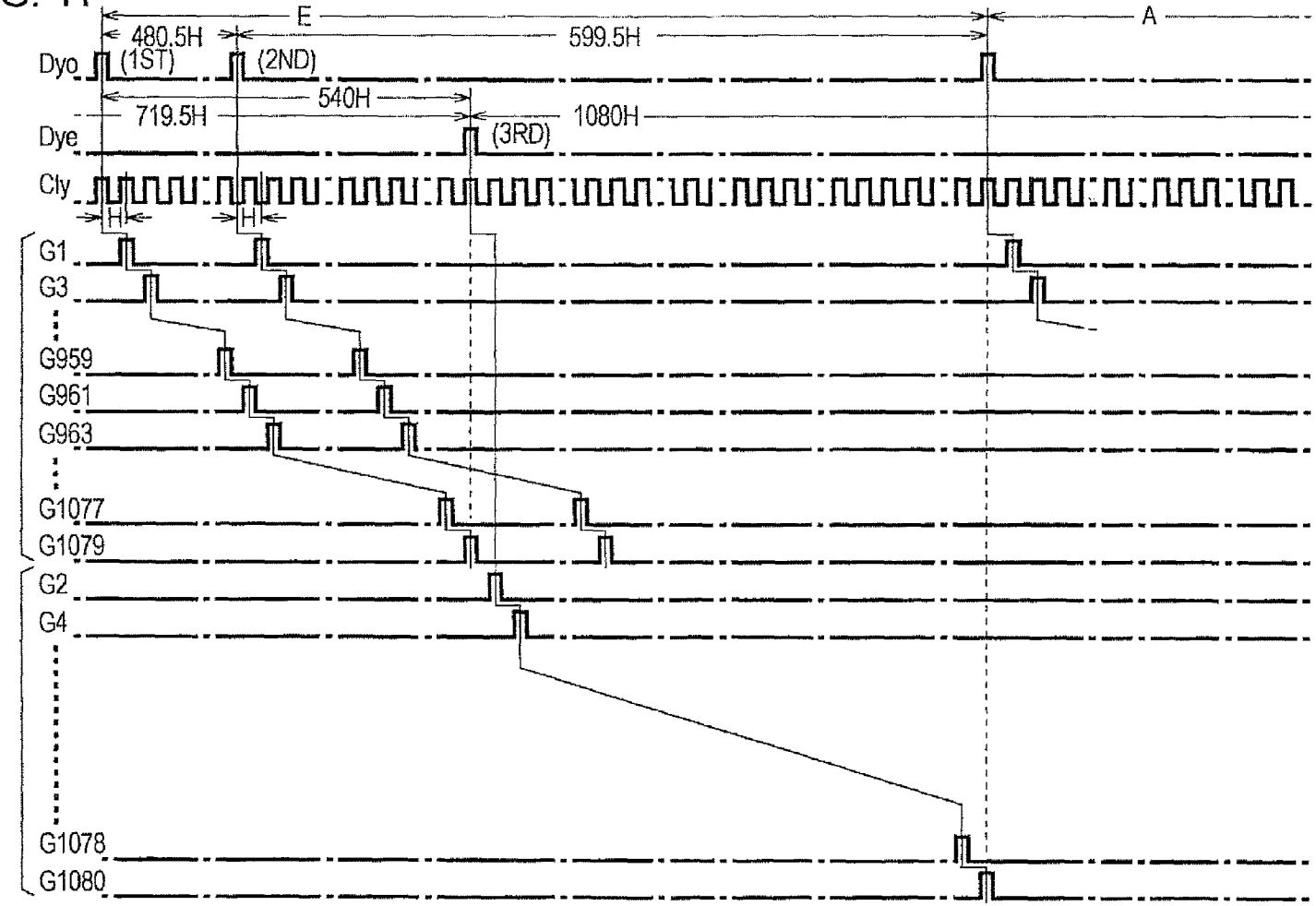
FIG. 11 is a timing chart showing the operation of the scanning line driving circuit.

Next, a description will be given, with reference to FIGS. 7 to 11, of scanning signals generated by the scanning line driving circuit 130. FIG. 7 is a timing chart showing scanning signals G1 to G1080 in a period A. FIGS. 8, 9, 10, and 11 are each a timing chart showing scanning signals G1 to G1080 in periods B, C, D, and B, respectively.

For the horizontal axis direction indicating the time axis in FIGS. 7 to 11, the shown period (for example, 120.5H) is correct, but the scale is for the sake of convenience and is not necessarily correct.

As shown in FIG. 7 or 3B, when the first pulse serving as the start pulse Dyo is output at the start timing of the period A by the control circuit 10, the second pulse serving as a start pulse Dyo is output after an elapse of 120.5H from the start timing. On the other hand, the start pulse Dye is delayed by 2700H corresponding to ½ fields with respect to the start pulse Dyo and is output. Therefore, the third pulse of the start pulse Dye is output after an elapse of 540H from the start timing of the period A and also, the fourth pulse of the start pulse Dye is output when 240.5H has passed from the output.

Since the first pulse of the start pulse Dyo is sequentially delayed every cycle of the clock signal Cly by the shift register 131, scanning signals G1, G3, G5, . . . , G1079 for odd-numbered rows are signals in which the first pulse is shifted every 1H, that is, reach an H level in sequence in the period in which the clock signal Cly reaches an H level.

When the second pulse of the start pulse Dyo is output again after an elapse of 120.5H from the start timing of the period A, the second pulse is sequentially delayed every cycle of the clock signal Cly by the shift register 131 in a similar manner, and is output as scanning signals G1, G3, G5, . . . , G1079. Here, when the second pulse is output, the first pulse supplied at the start timing of the period A is in the middle of being transferred in the shift register 131.

However, since the second pulse is output when 120.5H has passed from the start timing of the period A and the clock signal Cly is at an L level, the scanning signal by the transfer of the second pulse as the start pulse Dyo does not reach an H level overlappingly with the scanning signal by the transfer of the first pulse.

While the scanning signals G241 and G243 by the transfer of the first pulse reach an H level, the scanning signal G1 by the transfer of the second pulse is output so as to reach an H level.

Furthermore, the transfer of the first pulse is completed as a result of the scanning signal G1079 reaching an H level. The scanning signal that reaches an H level immediately before the scanning signal G1079 reaches an H level by the transfer of the first pulse is G837 by the transfer of the second pulse.

Therefore, in the period A, the scanning lines 112 are selected in the order of the 1st, 3rd, 5th, . . . , 241st rows by the transfer of only the first pulse, and are selected in the order of the 1st, 243rd, 3rd, 245th, . . . , 837th, 1079th rows by the parallel transfer of the second and first pulses.

On the other hand, when 540H has passed from the start timing of the period A, the third pulse serving as a start pulse Dye is output by the control circuit 10. The third pulse is delayed in sequence every cycle of the clock signal Cly by the shift register 132, and is output as scanning signals G2, G4, G6, . . . , G1080 for even-numbered rows. For this reason, the scanning signals G2, G4, G6, . . . , G1080 become signals in which the third pulse is shifted every H, that is, sequentially reaches an H level in the period in which the clock signal Cly reaches an H level.

The third pulse of the start pulse Dye is output at the same time as when 540H has passed from the first pulse of the start pulse Dyo, that is, when the scanning signal G1079 reaches an H level as a result of the shift register 131 transferring the first pulse. Furthermore, the third pulse is output when the clock signal Cly is at an H level.

Therefore, after the scanning signal G1079 reaches an H level by the transfer of the first pulse and then the scanning signal G839 reaches an H level by the transfer of the second pulse, the scanning signal G2 is output so as to reach an H level by the transfer of the third pulse. As a consequence, the scanning signals of even-numbered rows by the transfer of the third pulse do not reach an H level overlappingly with the scanning signals of odd-numbered rows by the transfer of the second pulse. On the other hand, the transfer of the second pulse is completed when the scanning signal G1079 reaches an H level. The scanning signal that reaches an H level immediately before the scanning signal G1079 reaches an H level by the transfer of the second pulse is G240 by the transfer of the third pulse.

Therefore, in the period A, the scanning lines are selected in the order of 839th, 2nd, 841st, 4th, . . . , (240th), 1079th rows by the parallel transfer of the second and third pulses.

Furthermore, the scanning signal that reaches an H level immediately after the scanning signal G1079 reaches an H level by the transfer of the second pulse is G242 by the transfer of the third pulse, and is a scanning signal G480 by the transfer of the third pulse immediately before the scanning signal G2 reaches an H level by the next transfer of the fourth pulse. Therefore, the scanning lines 112 are selected in the order of 242nd, 244th, 246th, . . . , 482nd rows by the transfer of only the third pulse.

In the period A, when a fourth pulse is output after an elapse of 240.5H after the third pulse of the start pulse Dye is output, similarly, the fourth pulse is delayed in sequence every cycle of the clock signal Cly by the shift register 132 and is recorded as scanning signals G2, G4, G6, . . . , G1080.

Here, when the start pulse Dye that is the fourth pulse is output, the start pulse Dye that is the third pulse is in the middle of being transferred in the shift register 132. However, since the fourth pulse is output when the clock signal Cly is at an L level after an elapse of 240.5H from the timing at which the third pulse is supplied, the scanning signal by the transfer of the fourth pulse serving as the start pulse Dye does not reach an H level overlappingly with the scanning signal by the transfer of the third pulse.

The scanning signal G2 by the transfer of the fourth pulse is output so as to be at an H level during the period in which the scanning signals G482 and G484 reach an H level by the transfer of the third pulse.

Furthermore, the transfer of the third pulse is completed as a result of the scanning signal G1080 reaching an H level. The scanning signal that reaches an H level immediately before the scanning signal G1080 reaches an H level by the transfer of the third pulse is G598 by the transfer of the fourth pulse. Therefore, in the period A, selection is made in the order of 2nd, 484th, 4th, 486th, . . . , 598th, 1080th rows by the parallel transfer of the fourth and third pulses.

As described above, in the period A, the scanning lines are selected in the order of 1st, 3rd, 5th, . . . , 241st rows by the transfer of only the first pulse; are selected in the order of 1st, 243rd, 3rd, 245th, . . . , 837th, 1079th rows by the parallel transfer of the second and first pulses; are selected in the order of 839th, 2nd, 841st, 4th, . . . , (240th), 1079th rows by the parallel transfer of the second and third pulses; are selected in the order of 242nd, 244th, 246th, . . . , 482nd rows by the transfer only the third pulse; and are selected in the order of 2nd, 484th, 4th, 486th, . . . , 598th, 1080th rows by the parallel transfer of the fourth and third pulses.

The scanning lines of the even-numbered rows of the 600th row and subsequent rows are selected in the next period B by the transfer of the fourth pulse.

Here, in the period A, the transfer of the first and second pulses causes the scanning lines of odd-numbered rows to be selected two times. The period from the time of the selection by the transfer of the first pulse to the time of the selection by the transfer of the second pulse corresponds to the sub-field sf1 of an odd-numbered row.

Furthermore, the transfer of the third and fourth pulses causes the scanning lines of even-numbered rows to be selected two times. The period from the time of the selection by the transfer of the third pulse to the time of the selection by the transfer of the fourth pulse corresponds to the sub-field sf6 of the even-numbered row of the preceding field.

Identical operations are performed in such a manner that outlines for the periods B, C, D, and E are shown in FIGS. 8, 9, 10, and 11, respectively, except that the supply timings of the start pulse Dyo serving as the second pulse and the start pulse Dye serving as the fourth pulse differ.

More specifically, in the period B, the scanning lines are selected in the order of 600th, 1st, 602nd, 3rd, (479th), 1080th rows by the parallel transfer of the fourth pulse in the period A and the first pulse in the period B; are selected in the order of 481st, 483rd, . . . , 721st rows by the transfer of only the first pulse; are selected in the order of 1st, 723rd, 3rd, 725th, . . . , 357th, 1079th rows by the parallel transfer of the second and first pulses; are selected in the order of 359th, 2nd, 361st, 4th, . . . , (720th), 1079th rows by the parallel transfer of the second and third pulses; are selected in the order of 722nd, 724th, 726th, . . . , 962nd rows by the transfer of only the third pulse; and are selected in the order of 2nd, 964th, 4th, 966th, . . . , 118th, 1080th rows by the parallel transfer of the fourth and third pulses.

The scanning lines of the even-numbered rows of the 120th row and subsequent rows will be selected in the next period C by the transfer of the fourth pulse.

At this point, the period from the time of the selection by the transfer of the second pulse in the period A to the time of the selection by the transfer of the first pulse in the period B corresponds to the sub-field sf2 of an odd-numbered row. The period from the time of the selection by the transfer of the first pulse in the period B to the time of the selection by the transfer of the second pulse in the period B corresponds to the sub-field sf3 of an odd-numbered row.

On the other hand, the period from the time of the selection by the transfer of the fourth pulse in the period A to the time of the selection by the transfer of the third pulse in the period B corresponds to the sub-field sf7 of an even-numbered row of the preceding field. The period from the time of the selection by the transfer of the third pulse in the period B to the time of the selection by the transfer of the fourth pulse in the period B corresponds to the sub-field sf8 of an even-numbered row of the preceding field.

In the period C, the scanning lines are selected in the order of 120th, 1st, 122nd, 3rd, . . . , (959th), 1080th rows by the parallel transfer of the fourth pulse in the period B and the first pulse in the period C. Since the second pulse of the start pulse Dyo is not output in the period C, the scanning lines are selected in the order of 961st, 963rd, . . . , 1079th rows by the transfer of only the first pulse. Thereafter, the scanning lines are selected in the order of 2nd, 4th, 6th, . . . , 242nd rows by the transfer of only the third pulse, and are selected in the order of 2nd, 244th, 4th, 26th, . . . , 838th, 1080th rows by the parallel transfer of the fourth and third pulses.

The scanning lines of the even-numbered rows of the 840th row and subsequent rows will be selected in the next period D by the transfer of the fourth pulse.

At this point, the period from the time of the selection by the transfer of the second pulse in the period B to the time of the selection by the transfer of the first pulse in the period C corresponds to the sub-field sf4 of an odd-numbered row.

On the other hand, the period from the time of the selection by the transfer of the fourth pulse in the period B to the time of the selection by the transfer of the third pulse in the period C corresponds to the sub-field sf9 of an even-numbered row of the preceding field. The period from the time of the selection by the transfer of the third pulse in the period C to the time of the selection by the transfer of the fourth pulse in the period C corresponds to the sub-field sf1 of an even-numbered row.

In the period D, the scanning lines are selected in the order of 840th, 1st, 842nd, 3rd, . . . (239th), 1080th rows by the parallel transfer of the fourth pulse in the period C and the first pulse in the period D; are selected in the order of 241st, 243rd, . . . , 481st rows by the transfer of only the first pulse; are selected in the order of 1st, 483rd, 3rd, 485th, . . . , 597th 1079th rows by the parallel transfer of the second and first pulses; are selected in the order of 599th, 2nd, 601st/4th, . . . , (480th) 1079th rows by the parallel transfer of the second and third pulses; are selected in the order of 482nd, 484th, 486th, . . . , 722nd rows by the transfer of only the third pulse; and are selected in the order of 2nd, 724th, 4th, 726th, . . . , 358th, 1080th rows by the parallel transfer of the fourth and third pulses.

The scanning lines of the even-numbered rows of the 360th row and subsequent rows will be selected in the next period E by the transfer of the fourth pulse.

At this point, the period from the time of the selection by the transfer of the first pulse in the period C to the time of the selection by the transfer of the first pulse in the period D corresponds to the sub-field sf5 of an odd-numbered row. The period from the time of the selection by the transfer of the first pulse in the period D to the time of the selection by the transfer of the second pulse in the period D corresponds to the sub-field sf6 of an odd-numbered row.

On the other hand, the period from the time of the selection by the transfer of the fourth pulse in the period C to the time of the selection by the transfer of the third pulse in the period D corresponds to the sub-field sf2 of an even-numbered row. The period from the time of the selection by the transfer of the third pulse in the period D to the time of the selection by the transfer of the fourth pulse in the period D corresponds to the sub-field sf3 of an even-numbered row.

In the period A, the scanning lines are selected in the order of 360th, 1st, 362nd, 3rd, . . . , (719th), 1080th rows by the parallel transfer of the fourth pulse in the period D and the first pulse in the period E; are selected in the order of 721st, 723rd, . . . , 961st rows by the transfer of only the first pulse; are selected in the order of 1st, 963rd, 3rd/965th, . . . , 117th, 1079th rows by the parallel transfer of the second and first pulses; and are selected in the order of 119th, 2nd, 121st, 4th, . . . , (960th), 1079th rows by the parallel transfer of the second and third pulses. In the period E, since the fourth pulse serving as the start pulse Dye is not output, the scanning lines are selected in the order of 962nd, 964th, . . . , 1080th rows by the transfer of only the third pulse.

At this point, the period from the time of the selection by the transfer of the second pulse in the period D to the time of the selection by the transfer of the first pulse in the period E corresponds to the sub-field sf7 of an odd-numbered row. The period from the time of the selection by the transfer of the first pulse in the period E to the time of the selection by the transfer of the second pulse in the period E corresponds to the sub-field sf8 of an odd-numbered row. The period from the time of the selection by the transfer of the second pulse in the period E to the time of the selection by the transfer of the first pulse in the period A in the next field corresponds to the sub-field sf9 of an odd-numbered row.

On the other hand, the period from the time of the selection by the transfer of the fourth pulse in the period D to the time of the selection by the transfer of the third pulse in the period E corresponds to the sub-field sf4 of an even-numbered row. The period from the time of the selection by the transfer of the third pulse in the period E to the time of the selection by the transfer of the third pulse in the period A in the next field corresponds to the sub-field sf8 of an even-numbered row.

As described above, according to scanning signals output by the scanning line driving circuit 130, in comparison with FIG. 3A, the sub-fields sf1, sf3, sf6, and sf8 in odd-numbered and even-numbered rows are slightly longer, and the sub-fields sf2, sf4, sf7, and sf9 are slightly shorter, but there is substantially no influence.

Data Line Driving Circuit

Next, the data line driving circuit 140 in FIG. 1 will be described below. The data line driving circuit 140 converts data Db converted using the conversion table 30 into a voltage of a polarity specified by the control circuit 10, and supplies the voltage as a data signal to the data line 114 of the column corresponding to the data Db. More specifically, when the data Db converted using the conversion table 30 is "1" indicating on of the liquid-crystal element 120 and it is specified that positive polarity is written to the liquid-crystal element 120 by the control circuit 10, the data line driving circuit 140 converts the data into a voltage Vw(+), and converts the data into a voltage Vw(−) if negative polarity is specified to be written. On the other hand, when the data is "0" indicating off of the liquid-crystal element 120 and positive polarity is specified to be written, the data line driving circuit 140 converts the data into a voltage Vb(+) and converts the data into a voltage Vb(−) if negative polarity is specified to be written.

Data signals supplied to the data line 114 of the 1st, 2nd, 3rd, . . . , 1920th columns are denoted as data signals d1, d2, d3, . . . , d1920, and a data signal of the j-th column is denoted as dj without specifying a column.

Figure 13:
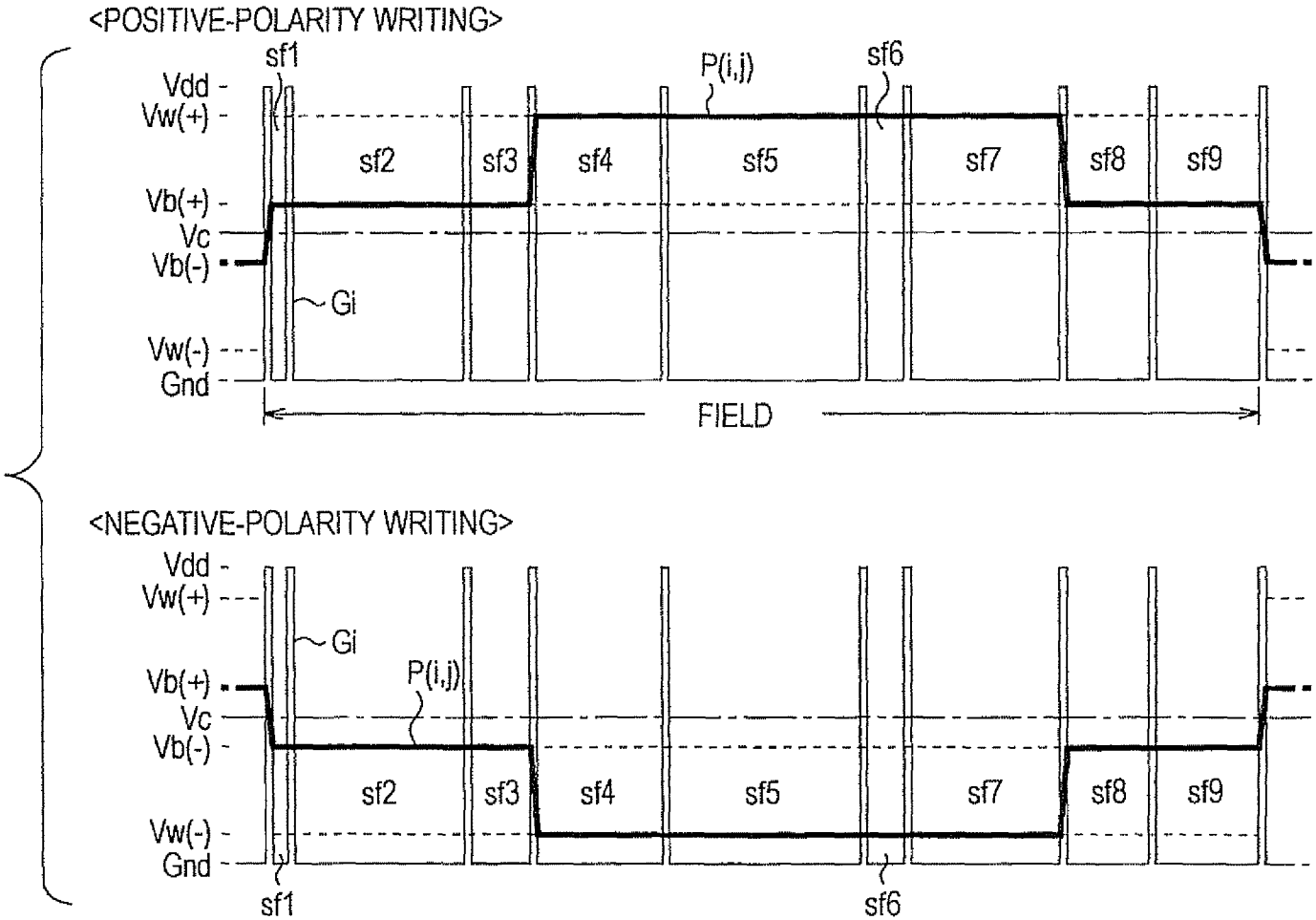
FIG. 13 shows writing of on/off in each sub-field of the electro-optical apparatus.

The voltages Vw(+) and Vw(−) are voltages that, when these are applied to the pixel electrode 118, cause a differential voltage between the pixel electrode 118 and the counter electrode 108 of the liquid-crystal element 120 to be an on voltage. As shown in FIG. 13, the voltages Vw(+) and Vw(−) are symmetrical with respect to a voltage Vc. As described above, in the present embodiment, since a voltage LCcom has been applied to the counter electrode 108, when a voltage Vw(+) is applied to the pixel electrode 118, a differential voltage between the voltage Vw(+) and the voltage LCcom is written as an on voltage to the liquid-crystal element 120, and when a voltage Vw(−) is applied to the pixel electrode 118, a differential voltage between the voltage Vw(−) and the voltage LCcom is written as an on voltage to the liquid-crystal element 120.

As described above, for an on voltage, a voltage that is about 1 to 1.5 times as high as the saturation voltage is used. When a voltage Vw(+) or Vw(−) is applied to the pixel electrode 118, a saturation response time up to the time when the reflectance of the liquid-crystal element 120 is saturated and a white color is produced is longer than the time period of the shortest sub-field sf1. In other words, the time period of the sub-field sf1 is set shorter than the saturation response time of the liquid-crystal element 120.

On the other hand, the voltages Vb(+) and Vb(−) are voltages that, when these are applied to the pixel electrode 118, cause a differential voltage of the liquid-crystal element 120 to be an off voltage, and as shown in FIG. 13, are symmetrical with respect to a voltage Vc. When the voltage Vb(+) is applied to the pixel electrode 118, a differential voltage between the voltage Vb(+) and the voltage LCcom is applied to the liquid-crystal element 120. When the voltage Vb(−) is applied as an off voltage to the pixel electrode 118, a differential voltage between the voltage Vb(−) and the voltage LCcom is applied as an off voltage to the liquid-crystal element 120.

At this point, when DC components are applied to the liquid-crystal element 120, the liquid crystal 105 degrades, and therefore, the pixel electrode 118 is alternately applied with a high level side voltage or a low level side voltage with respect to the reference voltage Vc (AC driving). In this AC driving, writing polarity refers to setting a voltage applied to the pixel electrode 118, that is, setting the voltage of a data signal to a high level side or a low level side with respect to the reference voltage Vc. When the voltage is set to the high level side, it means that the writing polarity is positive polarity. When the voltage is set to the low level side, it means that the writing polarity is negative polarity.

Therefore, the voltages Vw(+) and Vb(+) are positive-polarity voltages, and the voltages Vw(−) and Vb(−) are negative polarity voltages.

In the present embodiment, regarding the writing polarity, the voltage Vc is used as a reference. Regarding the voltage, a ground electric potential Gnd corresponding to an L level of the logic level is used as a reference of voltage zero unless otherwise specified.

The voltage LCcom applied to the counter electrode 108 is set to a slightly lower side than the reference voltage Vc. This is because, in an n-channel type transistor 116, push down in which the electric potential of the drain (pixel electrode 118) decreases when the n-channel transistor 116 switches from an on state to an off state because of a parasitic capacitance between the gate and drain electrodes occurs. If the voltage LCcom is made to match the reference voltage Vc, the voltage effective value of the liquid-crystal element 120 through negative polarity writing becomes slightly greater than the voltage effective value through positive polarity writing (when the transistor 116 is of an n channel type) due to push down. For this reason, the voltage LCcom is set to an appropriate value that cancels the influence of push down in such a manner that the voltage LCcom is offset to the low level side with respect to the reference voltage Vc. However, if influence of push down may be ignored, the voltage LCcom and the reference voltage Vc are set to match each other.

Furthermore, as described above, since the liquid-crystal element 120 is AC-driven, in the present embodiment, the control circuit 10 is configured to alternately switch writing polarity between positive polarity and negative polarity for each period of one field with respect to the data line driving circuit 140.

Writing Operation

Next, a description will be given below of the display operation of the electro-optical apparatus 1.

As described above, the control circuit 10 supplies the start pulses Dyo and Dye and the clock signal Cly to the scanning line driving circuit 130, and on the basis of these signals, the scanning line driving circuit 130 generates scanning signals and supplies them to the scanning line 112. As a consequence, the control circuit 10 indirectly controls selection of the scanning lines.

As described above, in the period A, firstly, the scanning lines 112 are selected in the order of 1st, 3rd, 5th, . . . , 241st rows; secondly, are selected in the order of 1st, 243rd, 3rd, 245th, . . . , 837th, 1079th rows; thirdly, are selected in the order of 839th, 2nd, 841st, 4th, . . . , 240th, 1079th rows; fourthly, are selected in the order of 242nd/244th, 246th, . . . , 482nd rows; and fifthly, are selected in the order of 2nd, 484th, 4th, 486th, . . . , 598th, 1080th rows. For this reason, in the period A, the scanning lines 112 are selected two times except for the 600th row and subsequent rows of even-numbered rows.

Then, at the time of the first selection in odd-numbered rows, writing of a voltage corresponding to the sub-field sf1 of odd-numbered rows is performed. At the time of the second selection in odd-numbered rows, writing of a voltage corresponding to the sub-field sf2 of an odd-numbered row is performed. At the time of the first selection in even-numbered rows, writing of a voltage corresponding to the sub-field sf6 of an even-numbered row of the preceding field is performed. At the time of the second selection in even-numbered rows, writing of a voltage corresponding to the sub-field sf7 of an even-numbered row of the preceding field is performed.

In the period A, at first, a first selection is performed in the scanning line 112 of the first row. Before the selection, the control circuit 10 reads, from the memory 20, display data Da for pixels for one line of the 1st to 1920th columns positioned at the first row and supplies the data to the conversion table 30. As a result, in the conversion table 30, the display data Da is sequentially converted into data Db for applying an on or off voltage to the liquid-crystal element 120 on the basis of the gray-scale level specified by the display data Da and the sub-field sf1. For example, if the read display data Da is one that specifies a gray-scale level "13", it is converted into "0" for the purpose of applying an off voltage to the liquid-crystal element 120 on the basis of the sub-field sf1 (see FIG. 5).

As described above, in the present embodiment, the writing polarity is alternately switched between positive polarity or negative polarity for each period of one field, and positive polarity writing is assumed to be specified in this one field.

The data line driving circuit 140 stores the converted data Db for an amount corresponding to one line, the data corresponding to the first row and the first column to the first row and the 1920th column. Thereafter, when the scanning signal G1 of the first row reaches an H level, if the data Db is "1", the data line driving circuit 140 converts the data into a voltage Vw(+), and if the data Db is "0", the data line driving circuit 140 converts the data into a voltage Vb(+). Then, the data line driving circuit 140 supplies it as data signals d1 to d1920 to the data lines 114 of the 1st to 1920th columns. For example, if the data Db of the first row and the j-th column is "0", the data signal dj is converted into a voltage Vb(+) when the scanning signal G1 reaches an H level.

When the scanning line 112 of the 1st row is selected and the scanning signal G1 reaches an H level, all the transistors 116 of the pixels 110 positioned in the 1st row are turned on, and as a result, the voltage of the data signal supplied to the data line 114 is applied to the pixel electrode 118. For this reason, in the liquid-crystal elements 120 in the pixels in the first row and in the 1st, 2nd, 3rd, 4th, . . . , 1920th columns, a positive-polarity voltage Vw(+) corresponding to an on state specified using the data Db or a positive-polarity voltage Vb(+) corresponding to an off state specified using the data Db is applied to the pixel electrode, and the voltage is held at the differential voltage with the voltage LCcom applied to the counter electrode 108. As a result, an on or off voltage is applied to the liquid-crystal element 120 of the 1st row on the basis of the specified gray-scale level and the sub-field sf1. This differential voltage is maintained by the capacitive property even if the transistor 116 is turned off.

Next, the scanning line 112 of the 3rd row is selected for the first time with the period of the half cycle of the clock signal Cly in between, and also at this time, identical operations are performed. That is, before the scanning line 112 of the 3rd row is selected, the display data Da for pixels for one line of the 1st to 1920th columns, which are positioned in the 3rd row, is read from the memory 20 and also, is sequentially converted into data Db on the basis of the gray-scale level and the sub-field sf1 by using the conversion table 30. After the converted data Db corresponding to the third row and the first column to the third row and the 1920th column is stored in the data line driving circuit 140 in an amount corresponding to one row, when the scanning signal G3 of the 3rd row reaches an H level, the data is converted into a positive-polarity voltage Vw(+) or Vb(+), and is supplied as data signals d1 to d1920 to the data lines 114 of the 1st to 1920th columns, respectively. When the scanning signal G3 reaches an H level, all the transistors 116 positioned in the 3rd row are turned on. As a consequence, in each of the liquid-crystal elements 120 in the pixels of the 3rd row and the 1st, 2nd, 3rd, 4th, . . . , 1920th columns, the voltage Vw(+) or Vb(+) corresponding to the data Db is applied to the pixel electrode, thereby being held at the differential voltage with the voltage LCcom.

Such a selection of the scanning lines 112 is repeated up to the odd-numbered 241st row.

When the first selection is completed in the scanning line 112 of the 241st row, a second selection is performed in the scanning line 112 of the 1st row. Since the second selection in the scanning line 112 of the 1st row indicates writing of a voltage corresponding to the sub-field sf2, an on or off voltage is applied to the liquid-crystal element 120 of the 1st row on the basis of the specified gray-scale level and the sub-field sf2.

When the second selection in the scanning line 112 of the 1st row is completed, a first selection is performed in the scanning line 112 of the 243rd row. As a result, an on or off voltage is applied to the liquid-crystal element 120 of the 243rd row on the basis of the specified gray-scale level and the sub-field sf1. The scanning lines 112 are hereinafter selected in the order of 3rd, 245th, 5th, 247th, . . . , 837th, 1079th rows. Since the selection of the 3rd, 5th, . . . , 837th rows is performed at a second time, writing of a voltage corresponding to the sub-field sf2 is performed. On the other hand, since the selection of the 245th, 247th, . . . , 1079th rows is performed at a first time, writing of a voltage corresponding to the sub-field sf1 is performed.

When the second selection in the scanning line 112 of the 1079th row is completed, the scanning lines 112 are selected in the order of 839th, 2nd, 841st, 4th, . . . , 240th, 1079th rows. Since the selection of the 839th, 841st, 1079th rows, which are odd-numbered rows, is performed at a second time, writing of a voltage corresponding to the sub-field sf2 is performed. Since the selection of the 2nd, 4th, . . . , 240th rows, which are even-numbered rows, is performed at a first time, writing of a voltage corresponding to the sub-field sf6 of the preceding field is performed.

When the first selection in the scanning line 112 of the 240th row is completed, the scanning lines 112 are selected in the order of 242nd, 244th, 246th, . . . , 482nd rows with the period of the half cycle of the clock signal Cly in between. Since both the selections are performed at a first time, writing of a voltage is performed on the basis of the sub-field sf6 of the preceding field.

When the first selection in the scanning line 112 of the 482nd row is completed, the scanning lines 112 are selected in the order of 2nd, 484th, 4th, 486th, . . . , 598th, 1080th rows. Since the selection of the 2nd, 4th, . . . , and 598th rows is performed at a second time, writing of a voltage is performed on the basis of the sub-field sf7 of the preceding field. Since the selection of the 484th, 486th, . . . , 1080th row is performed at a first time, writing of a voltage is performed on the basis of the sub-field sf6 of the preceding field.

Since the voltage to be written on the basis of the sub-fields sf6 and sf7 in even-numbered rows is a voltage of the preceding field with respect to odd-numbered rows, the voltage has a negative polarity.

In the period B, when scanning lines of even-numbered rows are selected as a result of the fourth pulse supplied in the period A being transferred in the period B, writing of a voltage corresponding to the sub-field sf7 is performed on the pixels positioned in the selected scanning lines.

In the period B, when the scanning lines of odd-numbered rows are selected as a result of the first and second pulses supplied in the period B being transferred, writing of a voltage corresponding to the sub-fields sf3 and sf4 is performed on the pixels positioned in the selected scanning lines. On the other hand, when scanning lines of even-numbered rows are selected as a result of the third and fourth pulses supplied in the period B being transferred, writing of a voltage corresponding to the sub-fields sf8 and sf9 is performed on the pixels positioned in the selected scanning lines.

In the period C, when the scanning lines of even-numbered rows are selected as a result of the fourth pulse supplied in the period B being continuously transferred in the period C, writing of a voltage corresponding to the sub-field sf9 is performed on the pixels positioned in the selected scanning lines.

In the period C, when the scanning lines of odd-numbered rows are selected as a result of the first pulse supplied in the period C being transferred, writing of a voltage corresponding to the sub-field sf5 is performed on the pixels positioned in the selected scanning lines. On the other hand, when the scanning lines of even-numbered rows are selected as a result of the third and fourth pulses supplied in the period C being transferred, writing of a voltage corresponding to the sub-fields sf1 and sf2 is performed on the pixels positioned in the selected scanning lines.

The voltage written on the basis of the sub-fields sf1 and sf2 in even-numbered rows has a positive polarity because it is one field, which is the same as in odd-numbered rows.

In the period D, when the scanning lines of even-numbered rows are selected as a result of the fourth pulse supplied in the period C being continuously transferred in the period D, writing of a voltage corresponding to the sub-field sf2 is performed on the pixels positioned in the selected scanning lines.

In the period D, when the scanning lines of odd-numbered rows are selected as a result of the first and second pulses supplied in the period D being transferred, writing of a voltage corresponding to the sub-fields sf6 and sf7 is performed on the pixels positioned in the selected scanning lines. On the other hand, when the scanning lines of even-numbered rows is selected as a result of the third and fourth pulses supplied in the period D being transferred, writing of a voltage corresponding to the sub-fields sf3 and sf4 is performed on the pixels positioned in the selected scanning lines.

In the period E, when the scanning lines of even-numbered rows are selected as a result of the fourth pulse supplied in the period D being continuously transferred in the period E, writing of a voltage corresponding to the sub-field sf4 is performed on the pixels positioned in the selected scanning lines.

In the period E, when the scanning lines of odd-numbered rows are selected as a result of the first and second pulses supplied in the period E being transferred, writing of a voltage corresponding to the sub-fields sf8 and sf9 is performed on the pixels positioned in the selected scanning lines. On the other hand, when the scanning lines of even-numbered rows are selected as a result of the third pulse supplied in the period E being transferred, writing of a voltage corresponding to the sub-field sf5 is performed on the pixels positioned in the selected scanning lines.

When the process is returned from the period E to the period A, because it is the next field in odd-numbered rows, negative polarity writing is specified. For this reason, when the converted data Db is "1", a voltage Vw(−) is written into the liquid-crystal element 120 of an odd-numbered row, and a voltage Vb(−) is written into the liquid-crystal element 120 when the converted data Db is "0", thereby being held.

On the other hand, in even-numbered rows, even if the process is returned to the period A, because it is the sub-field sf6, positive polarity writing is specified up to the sub-field sf9 in the middle of the period C.

FIG. 13 shows a voltage P (i, j) of the pixel electrode 118 in the liquid-crystal element 120 of the i-th row and the j-th column.

If positive polarity writing is specified, the voltage P (i, j) becomes either a voltage Vw(+) for causing an on voltage to be applied to the liquid-crystal element 120 or a voltage Vb(+) for causing an off voltage to be applied thereto on the basis of the data Db when a scanning signal G1 reaches an H level, and is maintained over the period of each of the sub-fields. On the other hand, if negative polarity writing is specified, the voltage P (i, j) becomes a voltage Vw(−) for causing an on voltage to be applied to the liquid-crystal element 120 or a voltage Vb(−) for causing an off voltage to be applied thereto on the basis of the data Db when the scanning signal G1 reaches an H level, and is maintained over the period of each of the sub-fields.

FIG. 13 shows a case in which "24", is specified as a gray-scale level. If the gray-scale level is "24", an on voltage is applied to the liquid-crystal element 120 over the sub-fields sf4 to sf7, and an off voltage is applied thereto over the other sub-fields sf1 to sf3, sf8, and sf9.

For this reason, in FIG. 13, if positive polarity writing is specified, the voltage P (i, j) becomes a voltage Vw(+) over the sub-fields sf4 to sf7, and becomes a voltage Vb(+) over the sub-fields sf1 to sf3, sf8, and sf9, whereas, on the other hand, if negative polarity writing is specified, the voltage becomes a voltage Vw(−) over the sub-fields sf4 to sf7 and becomes a voltage Vb(−) over the sub-fields sf1 to sf3, sf8, and sf9.

Next, a description will be given, with reference to FIG. 12, of how selection for writing an on or off voltage corresponding to the sub-fields sf1 to sf9 to scanning lines of odd-numbered 1st, 3rd, 5th, . . . , 1079th rows, and scanning lines of even-numbered 2nd, 4th, 6th, 1080th rows progresses in the present embodiment.

Figure 12:
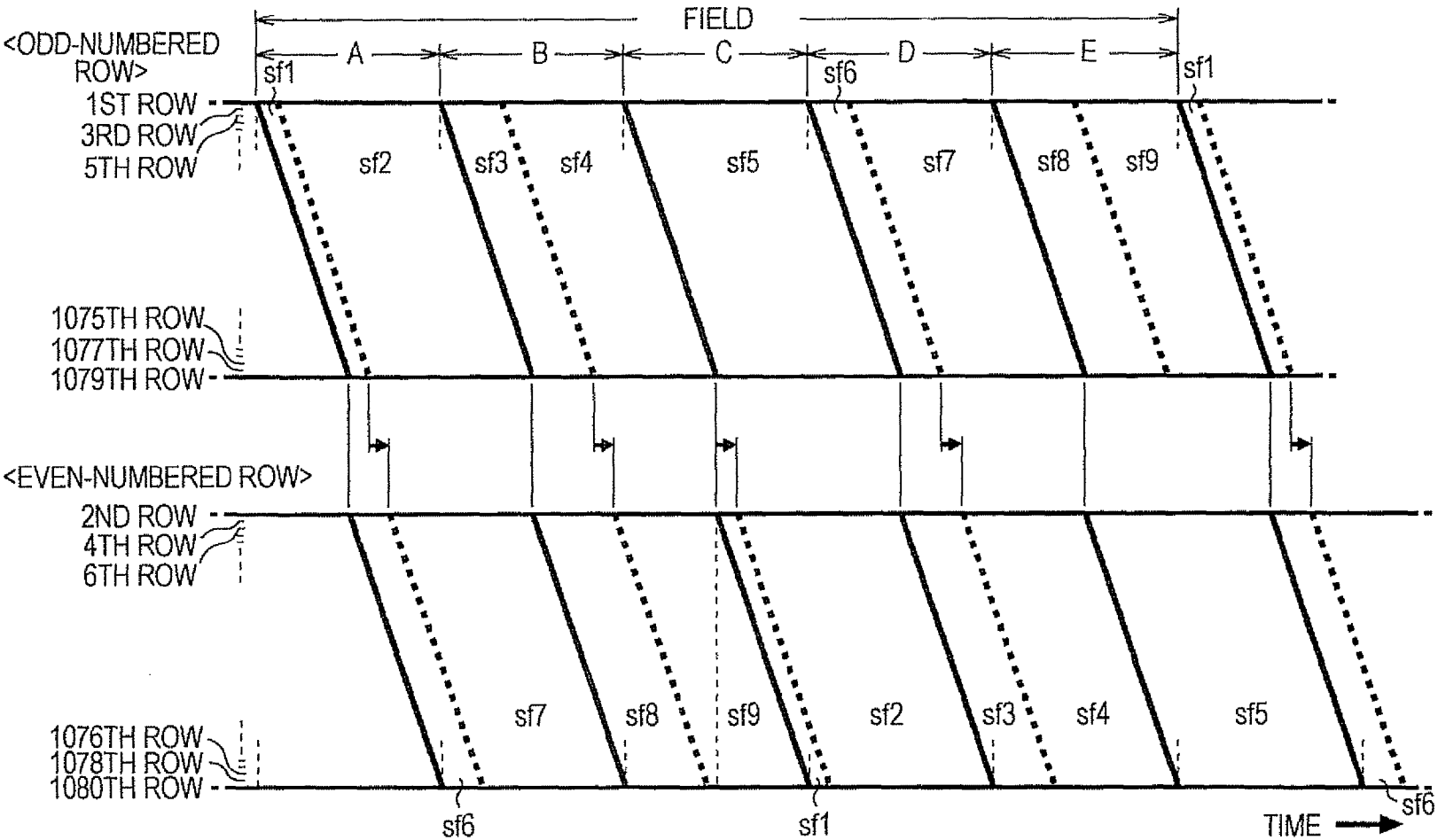
FIG. 12 shows the progress of writing in each sub-field of the electro-optical apparatus.

FIG. 12 also shows the progress of the selection of scanning lines for the purpose of writing an on or off voltage to scanning lines of odd-numbered rows and even-numbered rows over the periods A to E. In FIG. 12, the selection of scanning lines is shown using small dots. As the time passes, since the scanning lines are selected toward the downward direction, the small dots are shown as solid lines that are continuous in the right downward direction.

In the present embodiment, when a first pulse is supplied in the period A, the transfer of the first pulse allows the scanning lines to be selected in the order of 1st, 3rd, 5th, . . . , 1079th rows. As a result, an on or off voltage corresponding to the sub-field sf1 is written in odd-numbered rows. When a third pulse is supplied at the timing at which the selection of the odd-numbered rows is completed, the transfer of the third pulse allows scanning lines to be selected in the order of 2nd, 4th, 6th, 1080th rows. As a result, in even-numbered rows, an on or off voltage corresponding to the sub-field sf6 is written.

On the other hand, when a second pulse is supplied when a period corresponding to the sub-field sf1 passes from the supply of the first pulse, the transfer of the second pulse allows scanning lines of odd-numbered rows to be selected again. As a result, in odd-numbered rows, an on or off voltage corresponding to the sub-field sf2 is written. When a fourth pulse is supplied when a period 12H corresponding to the ratio "1" passes from the timing at which the selection of the odd-numbered rows is completed by the transfer of the second pulse, the transfer of the fourth pulse allows scanning lines of even-numbered rows to be selected, thereby causing an on or off voltage corresponding to the sub-field sf7 to be written in even-numbered rows. Therefore, the period of the sub-field sf6 of even-numbered rows is a period corresponding to a ratio "2" such that a delay time corresponding to the ratio "1" from the time when the selection of scanning lines of odd-numbered rows is completed to the time when the third pulse is supplied is added to "1", which is the ratio of the sub-field sf1 of odd-numbered rows, and is a predetermined value.

Similarly, in the period B (D), also, when the first pulse is supplied, odd-numbered scanning lines are selected in sequence by the transfer of the first pulse. In response, an on or off voltage corresponding to the sub-field sf3 (sf6) is written in odd-numbered rows. When the third pulse is supplied at the timing at which the selection of the odd-numbered rows is completed, even-numbered scanning lines are selected in sequence by the transfer of the third pulse, and in response, an on or off voltage corresponding to the sub-field sf8 (sf3) is written in even-numbered rows. On the other hand, when the second pulse is supplied when a time period corresponding to the sub-field sf3 (sf6) passes from the supply of the first pulse, odd-numbered scanning lines are selected in sequence by the transfer of the second pulse, and in response, an on or off voltage corresponding to the sub-field sf4 (sf7) is written in odd-numbered rows. When the fourth pulse is supplied when a period 120H corresponding to the ratio "1" passes from the timing at which the selection of the odd-numbered rows is completed by the transfer of the second pulse, even-numbered scanning lines are selected in sequence by the transfer of the fourth pulse, and in response, an on or off voltage corresponding to the sub-field sf9 (sf4) is written in even-numbered rows. Therefore, the period of the sub-field sf8 (sf3) of even-numbered rows is a period corresponding to a ratio "4" ("3") such that a delay time corresponding to a ratio "1" from the time when the selection of the scanning lines of odd-numbered rows is completed to the time when the third pulse is supplied is added to "3" ("2"), which is a ratio of the sub-field sf3 (sf6) of odd-numbered rows, and is a predetermined value.

In the period C, when the first pulse is supplied, odd-numbered scanning lines are selected in sequence by the transfer of the first pulse, and in response, an on or off voltage corresponding to the sub-field sf5 is written in odd-numbered rows. When the third pulse is supplied at the timing at which the selection of the odd-numbered rows is completed, even-numbered scanning lines are selected in sequence by the transfer of the third pulse, and in response, an on or off voltage corresponding to the sub-field sf1 is written in even-numbered rows.

Here, since the second pulse is not supplied in the period C, the fourth pulse is supplied at the timing at which the selection of the scanning lines of odd-numbered rows is completed, that is, when a period 12H corresponding to the ratio "1" passes from the timing at which the third pulse is supplied. Scanning lines of even-numbered rows are selected in sequence by the transfer of the fourth pulse, and an on or off voltage corresponding to the sub-field sf2 of even-numbered rows is written.

Furthermore, when the first pulse is supplied in the period E, odd-numbered scanning lines are selected in sequence by the transfer of the first pulse, and in response, an on or off voltage corresponding to the sub-field sf8 is written in odd-numbered rows. When the third pulse is supplied at the timing at which the selection of the odd-numbered rows is completed, even-numbered scanning lines are selected in sequence by the transfer of the third pulse, and in response, an on or off voltage corresponding to the sub-field sf5 is written in even-numbered rows. On the other hand, when the second pulse is supplied when a period corresponding to the sub-field sf8 passes from the supply of the first pulse, scanning lines of odd-numbered rows are selected in sequence by the transfer of the second pulse, and in response, an on or off voltage corresponding to the sub-field sf9 is written in odd-numbered rows. In the period E, the fourth pulse is not supplied.

In the present embodiment, the order in which scanning lines are selected in the periods A to R differs. Since the scanning line driving circuit 130 for driving scanning lines of each row needs only two shift registers 131 and 132 as shown in FIG. 6, the configuration can be simplified.

Furthermore, according to the present embodiment, since sub-fields in which an on or off voltage is applied to the liquid-crystal element are consecutive, even if the response speed increases due to temperature changes or the like, stepwise changes in accordance with a gray-scale level is ensured with regard to the reflectance of a liquid-crystal element. Therefore, it is possible to allow the actual brightness of pixels when one field is regarded as a unit period, that is, the reflectance of the liquid-crystal element, to be changed in a stepwise manner in a direction in which the liquid-crystal element becomes brighter as the gray-scale level increases even if temperature changes or the like occur.

In the present embodiment, as described above, sub-fields in which an on or off voltage is applied are consecutive. A group of sub-fields sf1 to sf9 is shifted from each other between odd-numbered rows and even-numbered rows, making it possible to suppress an occurrence of flicker.

This point will be described in detail. In the present embodiment, first, since sub-fields in which an on or off voltage is applied are consecutive, on (off) is repeated for each period of one field except for the gray-scale levels "0" and "45".

At this point, in a driving method in which scanning lines are selected in the order of 1st, 2nd, 3rd, 4th, . . . , 1079th, 1080th rows in each of the sub-fields sf1 to sf9 without making a distinction between odd-numbered rows and even-numbered rows, when rows in which gray-scale levels are made the same are consecutive, pixels of these consecutive rows are collected to become on in certain consecutive sub-fields and become off in the other sub-fields, and thus flicker is likely to be visually recognized.

In comparison, when a group of sub-fields sf1 to sf9 is shifted between odd-numbered rows and even-numbered rows as in the present embodiment, even if rows in which gray-scale levels are made the same are consecutive, periods in which an on voltage is applied differ between odd-numbered rows and even-numbered rows in the consecutive rows. For this reason, even if pixels having the same gray-scale level are collected, flicker can be made difficult to be visually recognized.

Figure 14:
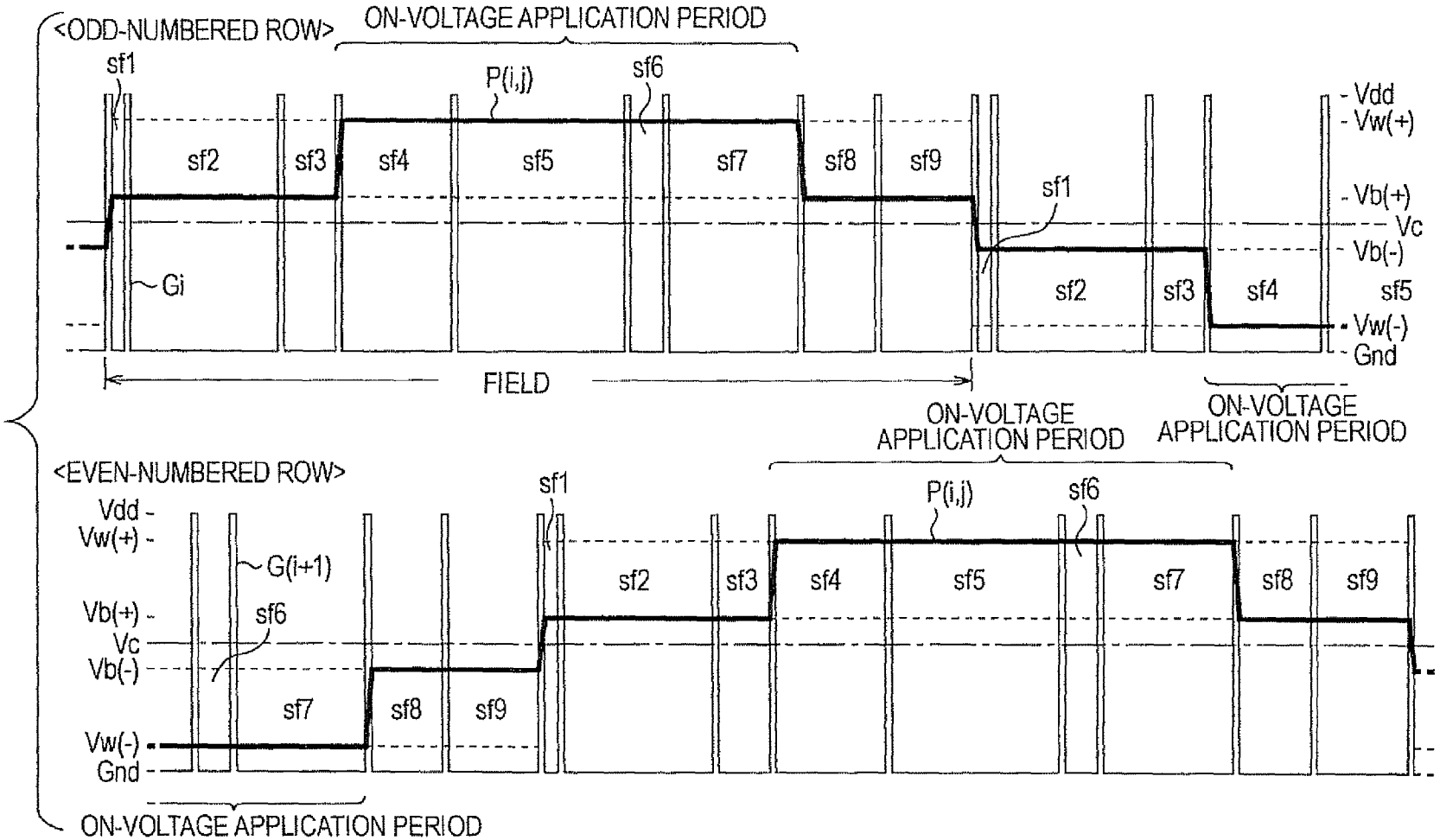
FIG. 14 shows differences in writing between odd-numbered rows and even-numbered rows of the electro-optical apparatus.

For example, when the gray-scale level is made to be "24", an on voltage is applied in the sub-fields sf4 to sf7. As shown in FIG. 14, since periods in which an on voltage is applied differ between odd-numbered rows and even-numbered rows, even if pixels in which the gray-scale level is the same are collected, flicker is difficult to be visually recognized.

Second Embodiment

Next, a description will be given of a second embodiment of the invention.

In the first embodiment, scanning lines of odd-numbered rows are selected in the order of 1st, 3rd, 5th, . . . , 1079th rows, and scanning lines of even-numbered rows are selected in the order of 2nd, 4th, 6th, . . . , 1080th rows. In the second embodiment, by using a technology disclosed in JP-A-2004-177930, scanning lines of odd-numbered rows are selected in an interlaced manner, and scanning lines of even-numbered rows are also selected in an interlaced manner.

An electro-optical apparatus according to the second embodiment is substantially the same as that of the first embodiment shown in FIG. 1 except that the conversion using the conversion table 30 and the configuration of the scanning line driving circuit 130 differ.

Accordingly, for the second embodiment, description will be given around these differences.

Figure 15A:
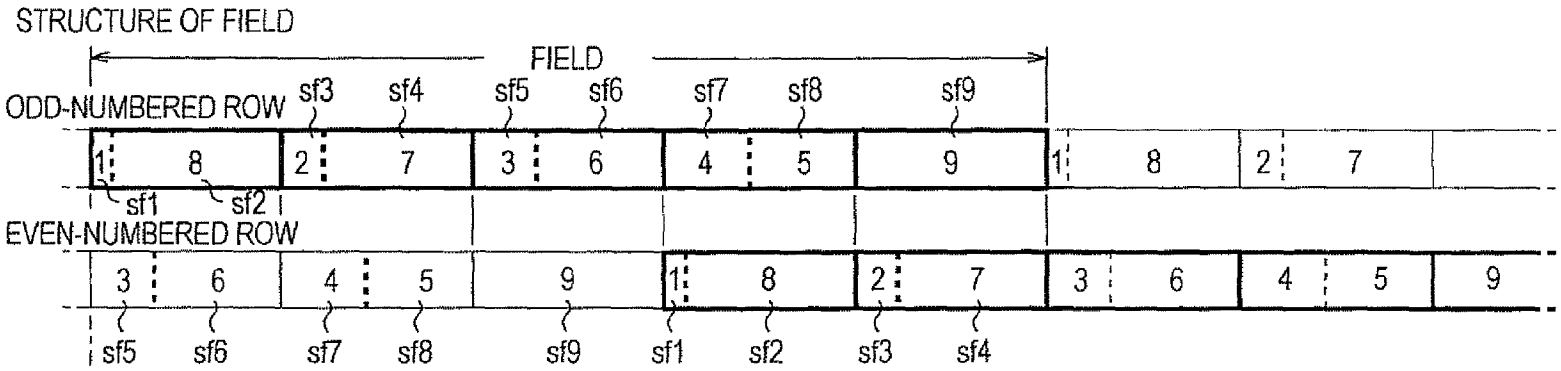
FIGS. 15A and 15B show the structure of fields of an electro-optical apparatus according to a second embodiment of the invention.

FIG. 15A shows the structure of fields in the electro-optical apparatus according to the second embodiment.

The present embodiment is common to the first embodiment (see FIG. 3A) in that one field is equally divided into five groups for both odd-numbered rows and even-numbered rows and are divided into nine sub-fields. If, for the sake of convenience, by using odd-numbered rows as a reference, sub-fields into which one field is divided are denoted as sf1 to sf9 in sequence, the ratios of the time periods of the sub-fields sf1 to sf9 are set so as to become "1", "8", "2", "7", "3", "6", "4", "5", and "9" in sequence starting from sf1, respectively.

With respect to the field of an odd-numbered i-th row, the field of an even-numbered (i+1)-th row is delayed by ⅗ fields, that is, by the time period of three groups or 216 degrees in terms of phase. For this reason, for example, when the odd-numbered i-th row is at the start timing of the sub-field sf1 in a certain field, the odd-numbered (i+1)-th row is at the start timing of the sub-field sf5 in the preceding field.

Figure 16:
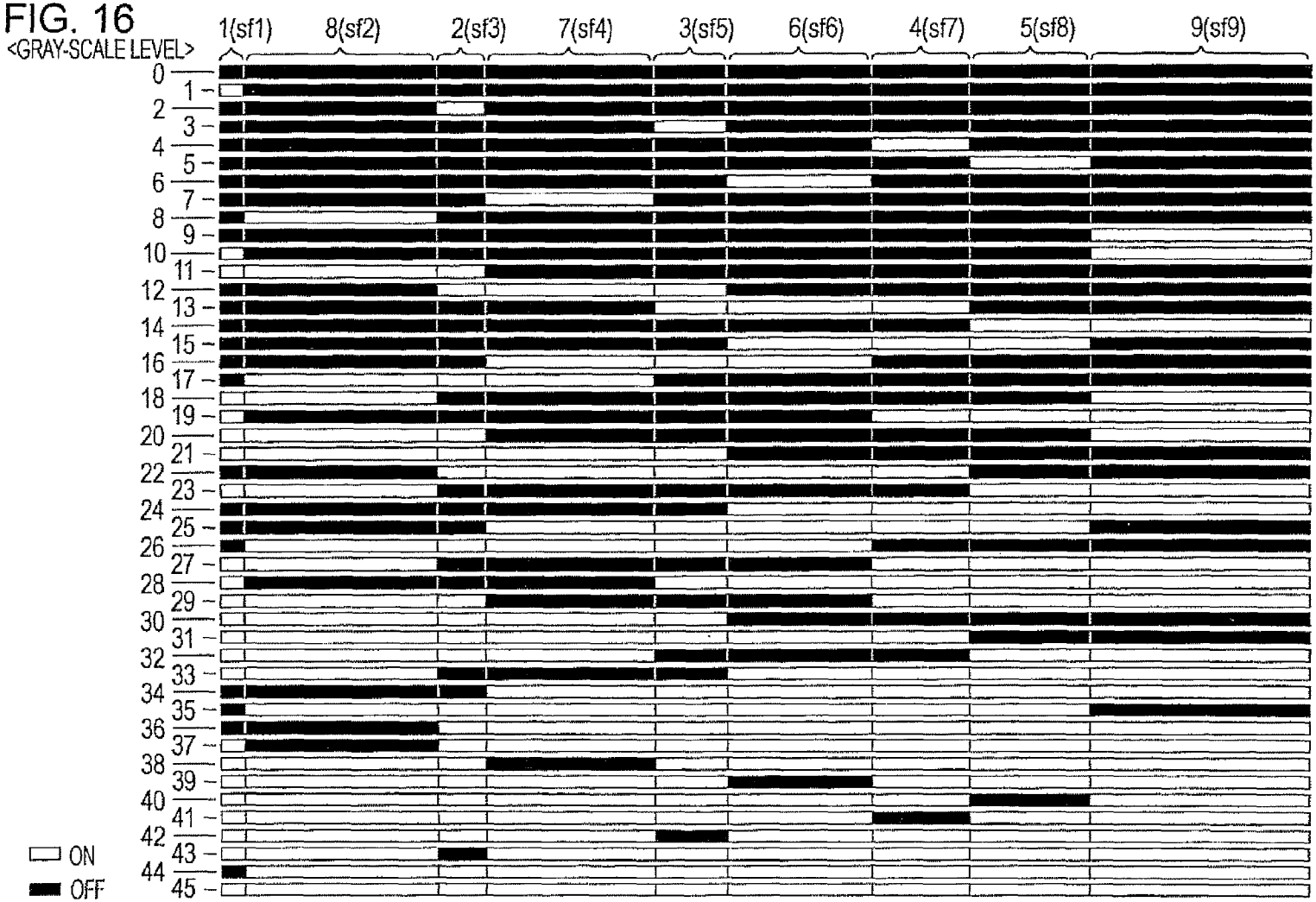
FIG. 16 shows a gray-scale display by the electro-optical apparatus.

FIG. 16 shows allocation of the application of an on or off voltage to the sub-fields sf1 to sf9 for each of the gray-scale levels "0" to "45" in the electro-optical apparatus according to the second embodiment. FIG. 17 shows conversion content of the conversion table 30 in the second embodiment.

In the second embodiment, for the sub-fields sf1 to sf9, the ratio of each period differs from the first embodiment (see FIG. 4). However, a manner in which an on voltage is assigned with regard to each gray-scale level is common between the first and second embodiments. For this reason, the first and second embodiments are common in that subfields in which an on/off voltage is applied are made consecutive.

FIG. 17 shows the conversion content of the conversion table 30 in the second embodiment. By specifying that an on or off voltage is applied to the liquid-crystal element in accordance with data Db by using the conversion content, the gray-scale display shown in FIG. 16 is realized.

Figure 18:
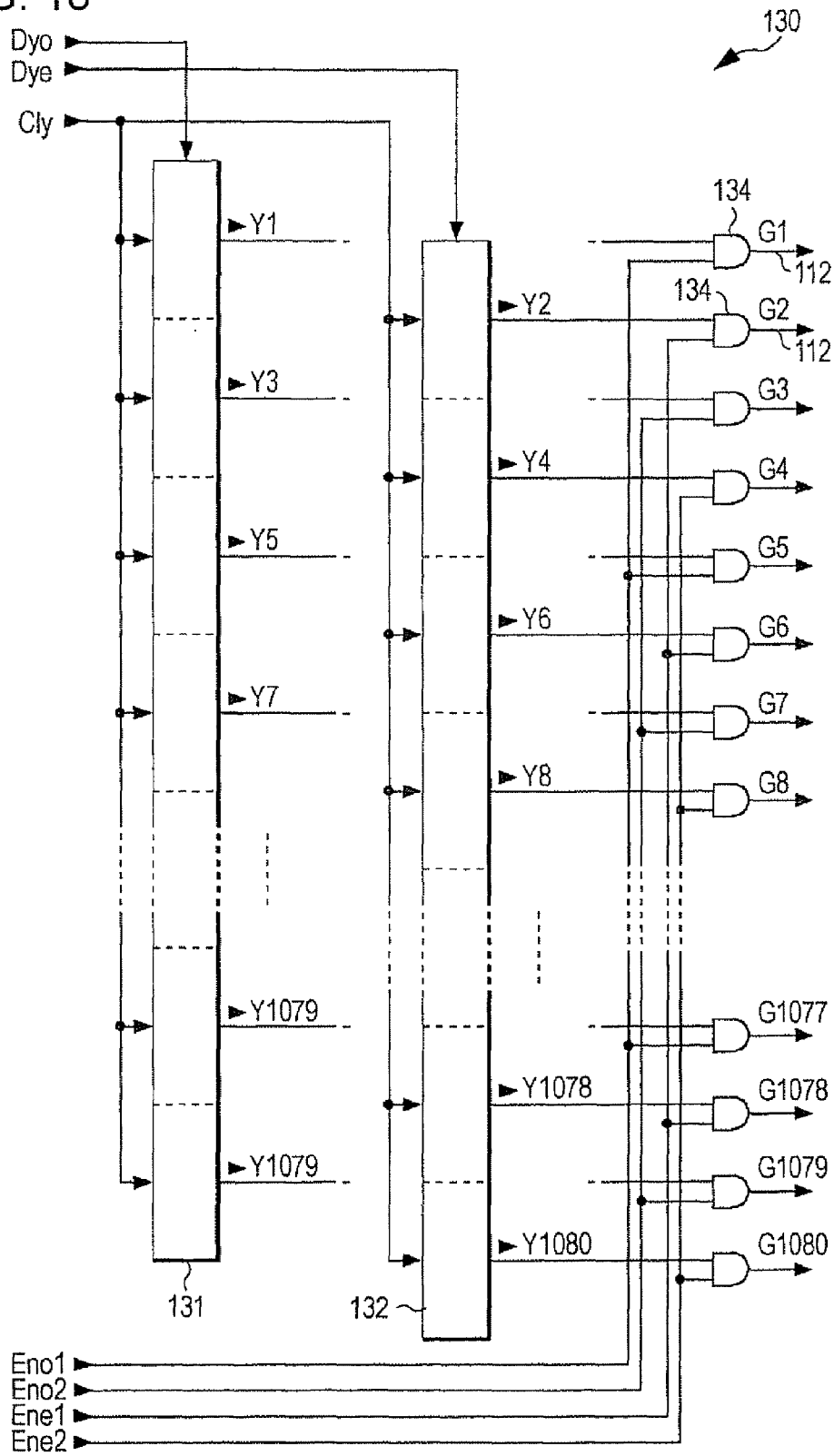
FIG. 18 shows the configuration of a scanning line driving circuit of the electro-optical apparatus.

FIG. 18 is a block diagram showing the configuration of the scanning line driving circuit 130 in the second embodiment. The scanning line driving circuit 130 shown in FIG. 18 includes AND circuits 134 for respective rows in addition to the shift registers 131 and 132 of 540 stages corresponding to odd-numbered rows and even-numbered rows.

Here, when shift signals output from each stage of the shift registers 131 of odd-numbered rows are denoted as Y1, Y3, Y5, . . . , Y1079 and shift signals output from each stage of the shift registers 132 of even-numbered rows are denoted as Y2, Y4, Y6, . . . , Y1080, the AND circuit 134 of each row determines an AND signal of an enable signal described below and the shift signal of the corresponding row, and outputs the signal as a scanning signal.

More specifically, the AND circuits 134 of 1st, 5th, 9th, . . . , 1077th rows among the odd-numbered rows output an AND signal of an enable signal Eno1 and the shift signal as a scanning signal. The AND circuits 134 of 3rd, 7th, 11th, . . . , 1079th rows output an AND signal of the shift signal and an enable signal Eno2 as a scanning signal. Here, the 1st, 5th, 9th, . . . , 1077th rows, which are rows of the AND circuits 134 to which the enable signal Eno1 is supplied, will be referred to as "series a" for the sake of convenience, and the 3rd, 7th, 11th, . . . , 1079th rows, which are rows of the AND circuits 134 to which the enable signal Eno2 is supplied, will be referred to as "series b" for the sake of convenience.

The AND circuits 134 of the 2nd, 6th, 10th, . . . , 1078th rows among the even-numbered rows output an AND signal of an enable signal Ene1 and the shift signal as a scanning signal. The AND circuits 134 of the 4th, 8th, 12th, . . . , 1080th rows output an AND signal of the shift signal and an enable signal Ene2 as a scanning signal. Here, the 2nd, 6th, 10th, . . . , 1078th rows, which are rows of the AND circuits 134 to which the enable signal Ene1 is supplied, will be referred to as "series c" for the sake of convenience, and the 4th, 8th, 12th, . . . , 1080th rows, which are rows of the AND circuits 134 to which the enable signal Ene2 is supplied, will be referred to as "series d" for the sake of convenience.

The enable signals Eno1, Eno2, Ene1, and Ene2 are each supplied from the control circuit 10, and the details thereof will be described later.

Figure 15B:
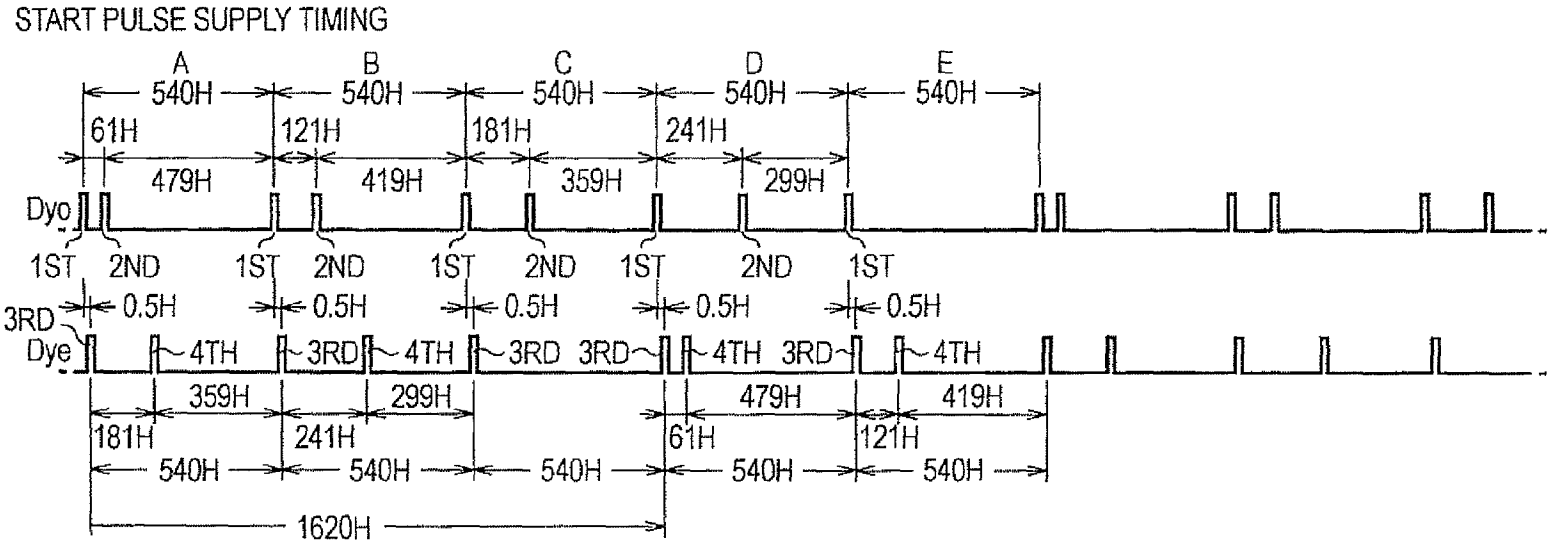

In the second embodiment, the clock signal Cly has a frequency, which is ½ in comparison with that of the first embodiment, and the start pulses Dyo and Dye are each supplied as shown in FIG. 15B.

Also, in the second embodiment, the time period of one field is 16.7 milliseconds in the same manner as in the first embodiment, and therefore, the time period of one group is 540H, which is 540 times as long as the clock signal Cly.

Next, the start pulse Dyo includes a pulse (first pulse), which is output at the start timing of the periods A, B, C, D, and E, of which the period of one field is divided into five portions, and at equal intervals every 540H of the clock signal Cly, and a pulse (second pulse), which is delayed by 61H, 121H, 181H, and 241H with respect to the first pulse output at the start timing of the periods A, B, C, and D, excluding the period E, among the first pulses output at equal intervals.

Here, in the second embodiment, when the first pulse within the start pulse Dyo is assumed to be output when the clock signal Cly is at an H level, the second pulse is also output as being at an H level when the clock signal Cly is at an H level.

The start pulse Dye includes a pulse (third pulse) that is output at a timing delayed by 0.5H from the first pulse of the start pulse Dyo, and a pulse (fourth pulse) that is delayed by 181H, 241H, 61H, and 121H from the output timing in the periods A, B, D, and E, excluding the period C within the third pulse. Since the third pulse of the start pulse Dye is output at a timing delayed by 0.5H from the first pulse of the start pulse Dyo, not only the third pulse but also the fourth pulse is output as being at an H level when the clock signal Cly is at an L level.

Unlike the first embodiment, the first to fourth pulses in the second embodiment do not indicate the output order in the periods A, B, C, D, and E.

Figure 19:
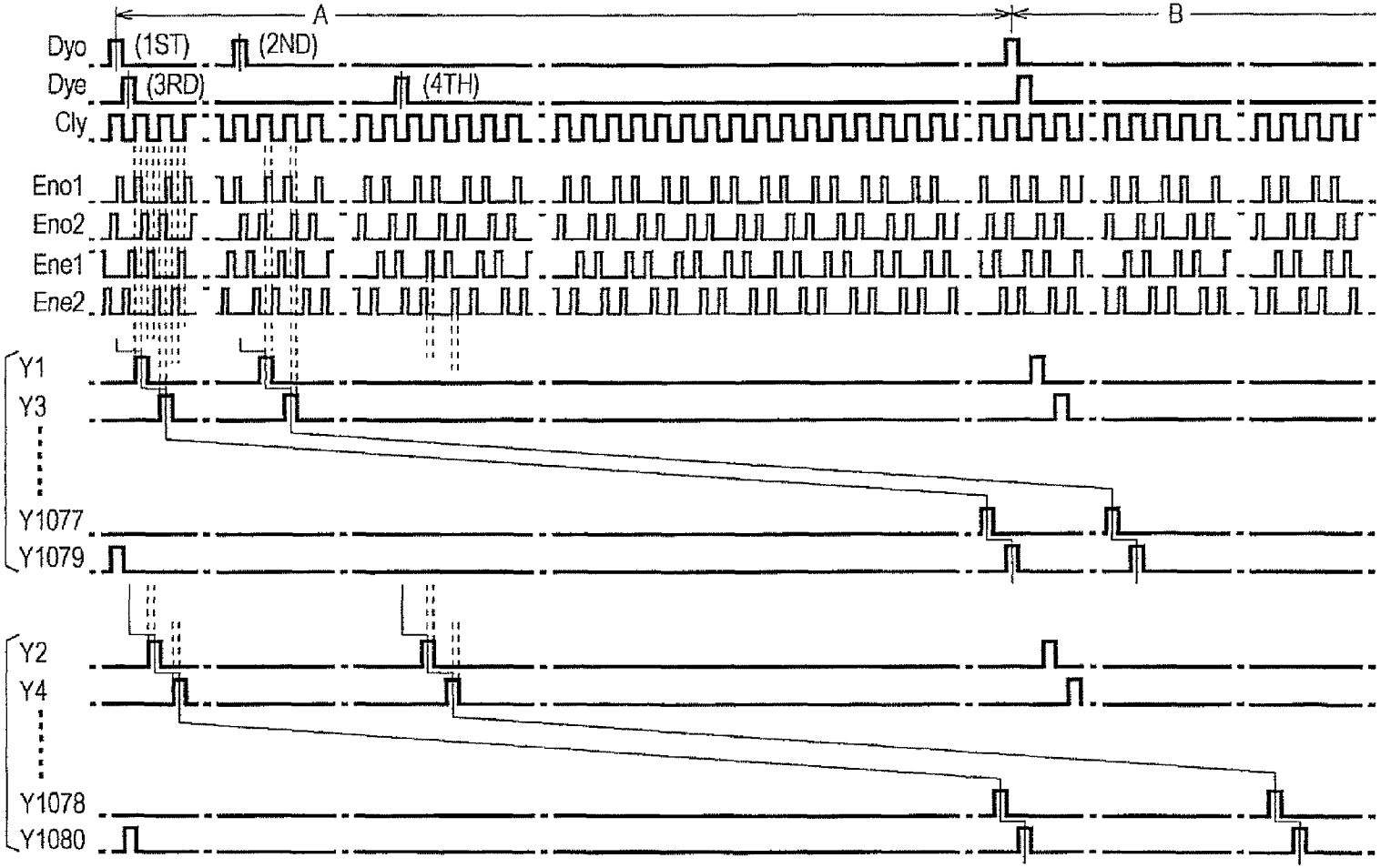
FIG. 19 is a timing chart showing the operation of the scanning line driving circuit.
Figure 20:
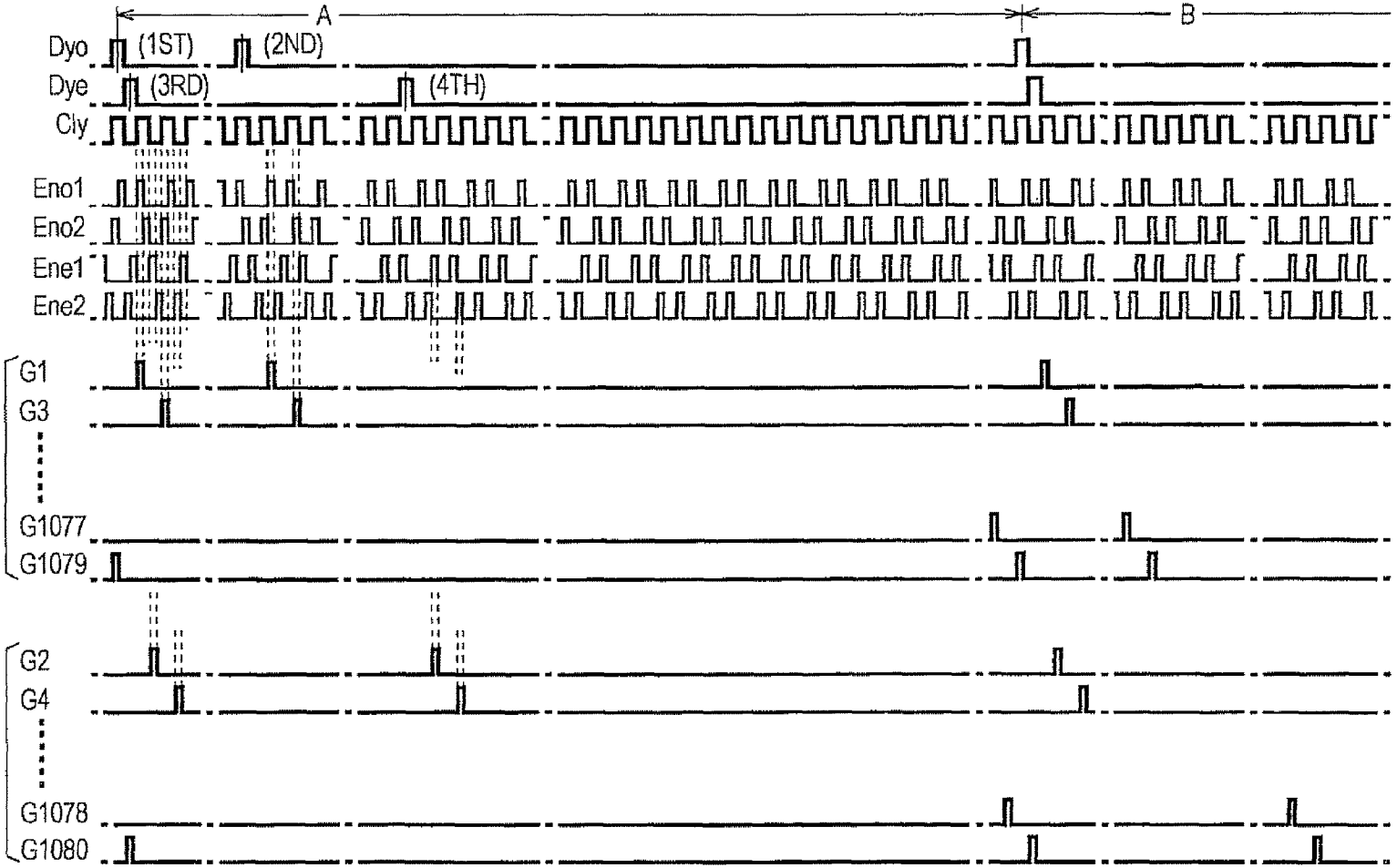
FIG. 20 is a timing chart showing scanning signals generated by the scanning line driving circuit.

As shown in FIG. 19 or 20, all the enable signals Eno1, Eno2, Ene1, and Ene2 have a pulse width of half of each pulse in the start pulses Dyo and Dye, that is, a pulse width corresponding to ¼ cycles of the clock signal Cly. These pulses are output in a mutually exclusive manner, and one cycle of each of the pulses corresponds to an amount of two cycles of the clock signal Cly.

More specifically, the enable signals Eno1, Eno2, Ene1, and Ene2 reach an H level in the following order when viewed by two cycles of the clock signal Cly after the first pulse of the start pulse Dyo and the third pulse of the start pulse Dye following the first pulse are supplied at the start timings of the periods A, B, C, D, and E. That is, firstly, pulses that reach an H level in the order of the enable signals Eno1 and Eno2 in the period in which the clock signal Cly reaches an H level are output. Secondly, pulses that reach an H level in the order of the enable signals Ene1 and Ene2 in the period in which the clock signal Cly reaches an L level are output. Thirdly, pulses that reach an H level in the order of the enable signals Eno2 and Eno1 in the period in which the clock signal Cly reaches an H level again are output. Fourthly, pulses that reach an H level in the order of the enable signals Ene2 and Ene1 in the period in which the clock signal Cly reaches an L level again are output.

In other words, when the ¼ cycles of the clock signal Cly are regarded as a unit, the logic level of the enable signal Eno1 is in the order of H→L→L→L→L→H→L→L→(H). With respect to such an enable signal Eno1, the phases of the enable signals Eno2, Ene1, and Ene2 lead by 180 degrees (lag), lag by 90 degrees, and lead by 90 degrees.

Next, a description will be given, with reference to FIGS. 19 and 20, of a scanning signal generated by the scanning line driving circuit 130 according to the second embodiment. FIG. 19 is a timing chart showing a shift signal in the period A. FIG. 20 is a timing chart showing a scanning signal in the period A.

As shown in FIG. 19, when the first pulse of the start pulse Dyo is supplied at the start timing of the period A, the first pulse is shifted in series by the shift register 131. As a consequence, the shift signals Y1, Y3, Y5, . . . , Y1079 become signals such that the first pulse is shifted every 1H, that is, reaches an H level in sequence in the period in which the clock signal Cly reaches an H level. Since the period required for the first pulse to be transferred from the first stage to the 54th stage is 540H, the shift signal Y1079 reaches an H level by the transfer of the first pulse at the completion timing of the period A.

On the other hand, when the third pulse of the start pulse Dye is supplied after being delayed by 0.5H from the supply of the first pulse of the start pulse Dyo, the third pulse is shifted in series by the shift register 132. As a consequence, the shift signals Y2, Y4, Y6, . . . , Y1080 are signals such that the third pulse is shifted every 1H, that is, reach an H level in sequence in the period in which the clock signal Cly reaches an L level. The period required for the third pulse to be transferred from the first stage to the 540th stage is 540H. Therefore, the time at which the shift signal Y1080 reaches an H level by the transfer of the third pulse is the completion timing of the period A, strictly speaking, is the time at which 0.5H passes from when the shift signal Y1079 reached an H level by the transfer of the first pulse.

Furthermore, the shift signals Y1, Y3, Y5, . . . , Y1079 of odd-numbered rows reach an H level in the period in which the clock signal Cly is at an H level, and the shift signals Y2, Y4, Y6, . . . , Y1080 of even-numbered rows reach an H level in the period in which the clock signal Cly is at an L level. As a consequence, the shift signals of odd-numbered rows and the shift signals of even-numbered rows do not reach an H level in an overlapping manner.

In the period A, when 61H passes from the time when the first pulse of the start pulse Dyo is supplied, the second pulse of the start pulse Dyo is supplied. Since the second pulse is shifted in series by the shift register 131, the shift signals Y1, Y3, Y5, . . . , Y1079 are signals such that the second pulse is shifted every 1H. Here, since the first pulse is in the middle of being transferred, in the period A, when the shift signal Y63 reaches an H level by the transfer of the first pulse, the shift signal Y1 reaches an H level by the transfer of the second pulse. Hereafter, in a similar manner, in the period A, when the shift signals Y65, Y67, Y69, . . . , Y1079 reach an H level by the transfer of the first pulse, the shift signals Y3, Y5, Y7, . . . , Y1017 reach an H level by the transfer of the second pulse. For this reason, in odd-numbered rows, two shift signals corresponding to the rows of the series a and the rows of the series b reach an H level at the same time.

It is in the period in which Y1, Y3, Y5, . . . , Y61 reach an H level by the transfer of the first pulse in the next period B that the shift signals Y1019, Y1021, . . . , Y1079 reach an H level by the transfer of the second pulse in the period A. This is the same in the case that two shift signals corresponding to the rows of the series a and the rows of the series b reach an H level at the same time.

On the other hand, when 181H passes from when the third pulse of the start pulse Dye is supplied in the period A, the fourth pulse of the start pulse Dye is supplied. Since the fourth pulse is shifted in series by the shift register 132, the shift signals Y2, Y4, Y6, . . . , Y1080 become signals such that the fourth pulse is shifted every 1H. Here, since the third pulse is in the middle of being transferred, when the shift signal Y184 reaches an H level by the transfer of the third pulse in the period A, the shift signal Y2 reaches an H level by the transfer of the fourth pulse. Hereinafter, in a similar manner, when the shift signals Y186, Y188, Y190, . . . , Y1080 reach an H level by the transfer of the third pulse in the period A, the shift signals Y4, Y6, Y8, . . . , Y898 reach an H level by the transfer of the fourth pulse. Therefore, in even-numbered rows, two shift signals corresponding to the rows of series c and the rows of series d reach an H level at the same time.

The period in which the shift signals Y900, Y902, Y1080 reach an H level by the transfer of the fourth pulse in the period A is the period in which the shift signals Y2, Y4, Y6, . . . , Y182 reach an H level by the transfer of the third pulse in the next period B. This is the same in the case that two shift signals corresponding to the rows of the series c and the rows of the series d reach an H level at the same time.

Figure 21:
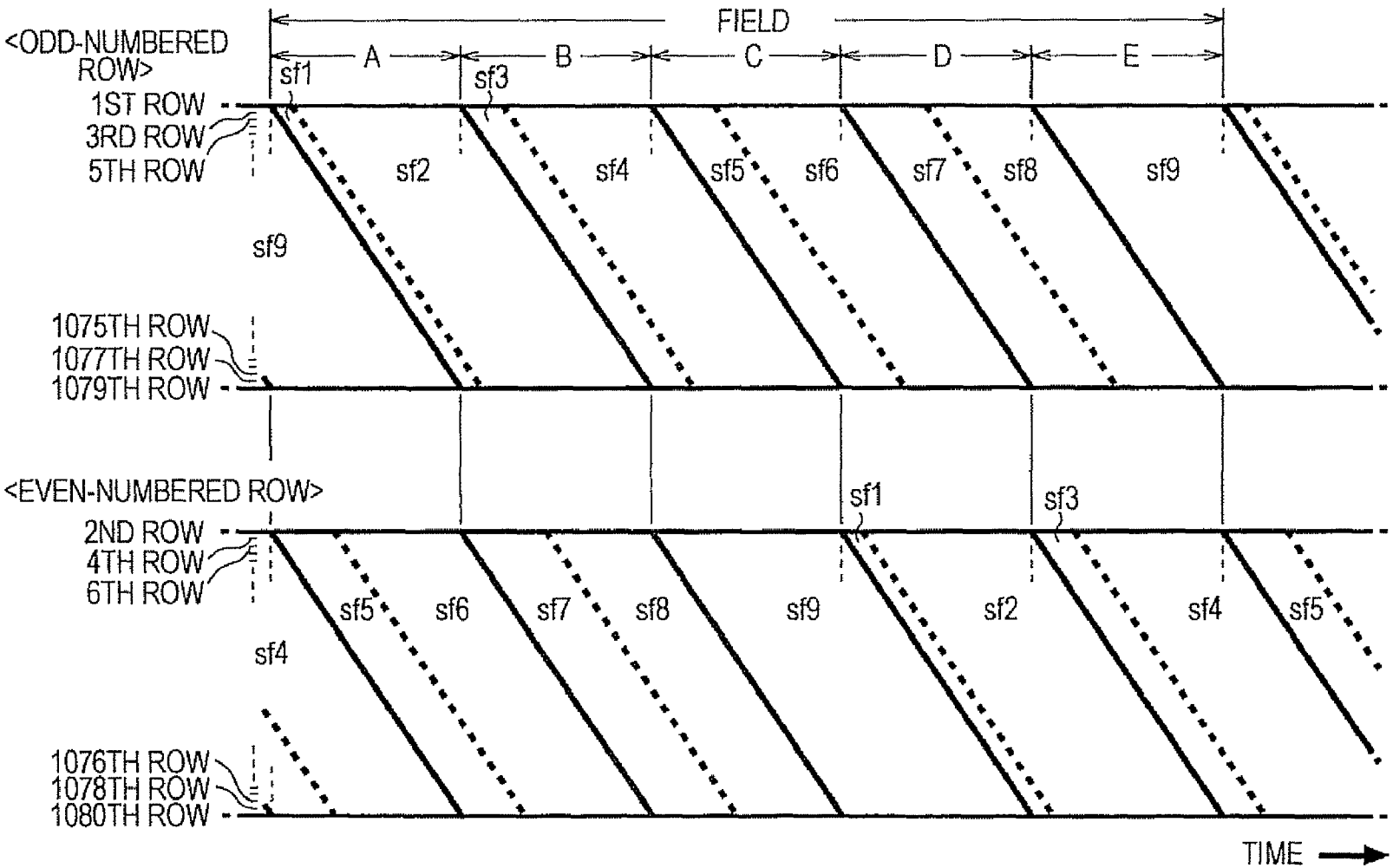
FIG. 21 shows the progress of writing in the electro-optical apparatus.

As described above, the AND signal of the shift signal that is output in this manner and one of the enable signals Eno1, Eno2, Ene1, and Ene2 is determined by the AND circuit 134, and is output as a scanning signal, as shown in FIG. 21.

More specifically, the pulse width of the shift signal of the series a of odd-numbered rows is narrowed on the basis of the AND with the enable signal Eno1, and the shift signal is output as a scanning signal. Similarly, for the shift signal of the series b of odd-numbered rows among the shift signals, the AND with the enable signal Eno2 is determined. For the shift signal of the series c of even-numbered rows, the AND with the enable signal Ene1 is determined. For the shift signal of the series d of even-numbered rows, the AND with the enable signal Ene1 is determined. The shift signals are each output as a scanning signal.

There is a case in which, in odd-numbered rows, shift signals for the rows of the series a and for the rows of the series b reach an H level at the same time. However, it does not occur that a scanning signal such that the shift signal for the rows of the series a is narrowed to the pulse width of the enable signal Eno1 and a scanning signal such that the shift signal for the rows of the series b is narrowed to the pulse width of the enable signal Eno2 reach an H level at the same time. Similarly, there is a case in which, in even-numbered rows, shift signals for the rows of the series c and for the rows of the series d reach an H level at the same time. However, it does not occur that a scanning signal such that the shift signal for the rows of the series c is narrowed to the pulse width of the enable signal Ene1 and a scanning signal such that the shift signal for the rows of the series d is narrowed to the pulse width of the enable signal Ene2 reach an H level at the same time.

In the period A, when the scanning signal of the odd-numbered rows reaches an H level by the transfer of the first pulse, writing of an on or off voltage corresponding to the sub-field sf1 is performed on pixels of odd-numbered rows, in which the scanning signal reaches an H level. When the scanning signal of the even-numbered rows reaches an H level by the transfer of the third pulse, writing of an on or off voltage corresponding to the sub-field sf5 of the preceding field is performed on pixels of even-numbered rows, in which the scanning signal reaches an H level. When the scanning signal of odd-numbered rows reaches an H level again by the transfer of the second pulse, writing of an on or off voltage corresponding to the sub-field sf2 is performed on pixels of odd-numbered rows, in which the scanning signal reaches an H level. When the scanning signal of even-numbered rows reaches an H level again by the transfer of the fourth pulse, writing of an on or off voltage corresponding to the sub-field sf6 of the preceding field is performed on pixels of even-numbered rows, in which the scanning signal reaches an H level.

Here, a description has been given of a shift signal and a scanning signal around the period A; however, the same applies to the periods B, C, D, and E except that supply timings of the second and fourth pulses differ.

For example, in the period B, when the scanning signal of odd-numbered rows reaches an H level by the transfer of the first pulse, writing of an on or off voltage corresponding to the sub-field sf3 is performed on pixels of the odd-numbered rows. When the scanning signal of even-numbered rows reaches an H level by the transfer of the third pulse, writing of an on or off voltage corresponding to the sub-field sf7 of the preceding field is performed on pixels of the even-numbered rows. When the scanning signal of odd-numbered rows reaches an H level again by the transfer of the second pulse, writing of an on or off voltage corresponding to the sub-field sf4 is performed on pixels of the odd-numbered rows. When the scanning signal of even-numbered rows reaches an H level by the transfer of the fourth pulse, writing of an on or off voltage corresponding to the sub-field sf8 of the preceding field is performed on pixels of the even-numbered rows.

In the period C, when the scanning signal of odd-numbered rows reaches an H level by the transfer of the first pulse, writing of an on or off voltage corresponding to the sub-field sf5 is performed on pixels of the odd-numbered rows. When the scanning signal of even-numbered rows reaches an H level by the transfer of the third pulse, writing of an on or off voltage corresponding to the sub-field sf9 is performed on pixels of the even-numbered rows. When the scanning signal of odd-numbered rows reaches an H level again by the transfer of the second pulse, writing of an on or off voltage corresponding to the sub-field sf6 is performed on pixels of the odd-numbered rows. In the second embodiment, the fourth pulse is not supplied in the period C.

In the period D, when the scanning signal of odd-numbered rows reaches an H level by the transfer of the first pulse, writing of an on or off voltage corresponding to the sub-field sf7 is performed on pixels of the odd-numbered rows. When the scanning signal of even-numbered rows reaches an H level by the transfer of the third pulse, writing of an on or off voltage corresponding to the sub-field sf1 is performed on pixels of the even-numbered rows. When the scanning signal of even-numbered rows reaches an H level again by the transfer of the fourth pulse, writing of an on or off voltage corresponding to the sub-field sf2 is performed on pixels of the even-numbered rows. When the scanning signal of odd-numbered rows reaches an H level by the transfer of the second pulse, writing of an on or off voltage corresponding to the sub-field sf8 is performed on pixels of the odd-numbered rows. In the period D, pulses are supplied in the order of the fourth and second pulses, and this order is reversed when compared with that in the periods A and B. In the period E, when the scanning signal of odd-numbered rows reaches an H level by the transfer of the first pulse, writing of an on or off voltage corresponding to the sub-field sf9 is performed on pixels of the odd-numbered rows. When the scanning signal of even-numbered rows reaches an H level by the transfer of the third pulse, writing of an on or off voltage corresponding to the sub-field sf3 is performed on pixels of the even-numbered rows. When the scanning signal of even-numbered rows reaches an H level again by the transfer of the fourth pulse, writing of an on or off voltage corresponding to the sub-field sf4 is performed on pixels of the even-numbered rows. In the second embodiment, the second pulse is not supplied in the period E.

FIG. 21 shows the progress of selection for writing an on or off voltage corresponding to the sub-fields sf1 to sf9 to scanning lines of odd-numbered 1st, 3rd, 5th, 1079th rows and even-numbered 2nd, 4th, 6th, . . . , 1080th rows in the second embodiment. In FIG. 21, similar to FIG. 12, selection of the scanning lines is shown with small dots for the purpose of writing of an on or off voltage to odd-numbered scanning lines and even-numbered scanning lines over the periods A to E. However, because the scanning lines are selected toward the lower side over time, the small dots are shown as solid lines that are continuous to the right lower direction.

According to such a second embodiment, since the frequency of the clock signal Cly can be made to be ½ that of the first embodiment, it is possible to reduce by half the operation speed of the shift registers 131 and 132.

Application and Modification

In the above-described embodiments, one of an on voltage and an off voltage is applied to the liquid crystal element 120 in each of the sub-fields sf1 to sf9; however, an intermediate (half) voltage may be added in addition to an on voltage and an off voltage, so that a larger number of gray-scale levels is provided without changing the structure of sub-fields. For example, in FIG. 4 or 5, in the gray-scale level "3", an on voltage is applied in only the sub-field sf6. However, when, in place of the on voltage, an intermediate voltage between the on and off voltages is applied, the actual reflectance (brightness) of the liquid-crystal element can be lowered than the gray-scale level "3". Furthermore, when an intermediate voltage is set so that the brightness of the liquid-crystal element when an intermediate voltage is applied to only the sub-field sf6 becomes an intermediate value between the gray-scale levels "2" and "3", it is possible to express brightness corresponding to, for example, a gray-scale level "2.5". By adding an intermediate voltage in addition to the on and off voltages in this manner, it is possible to express finer gray-scale levels, and a larger number of gray-scale levels can be provided.

The intermediate voltage may be specified as two or more types between the on and off voltages in addition to only one type.

In the above-described embodiments, p is set to "5", and one field is equally divided into five groups, four groups among the five groups are divided, and one field is formed of a total of nine sub-fields, making it possible to express 46 gray-scale levels. In addition, one field may be divided into six or more groups and may also be divided into two to four groups. That is, p may be an integer of two or more.

In the embodiments, the liquid-crystal element 120 has been described by using a normally black mode. Alternatively, a normally white mode in which a white display is made in a voltage non-application state may be used.

Furthermore, one dot may be formed using 3 pixels of R (red), G (green), and B (blue) in order to perform a color display. Color display may be performed with dots, each of which is constituted of three pixels, that is, R (red), G (green), and B (blue). In addition, the liquid crystal element is not limited to a reflective type, but it may be of a transmissive type or of a transflective type that is intermediate between the reflective type and the transmissive type.

In addition, the display element is not limited to a liquid crystal element, but the display element may be applied to, for example, devices that use an EL (Electronic Luminescence) element, an electron emission element, an electrophoretic element or a digital mirror element, or to a plasma display.

Electronic Apparatus

Figure 22:
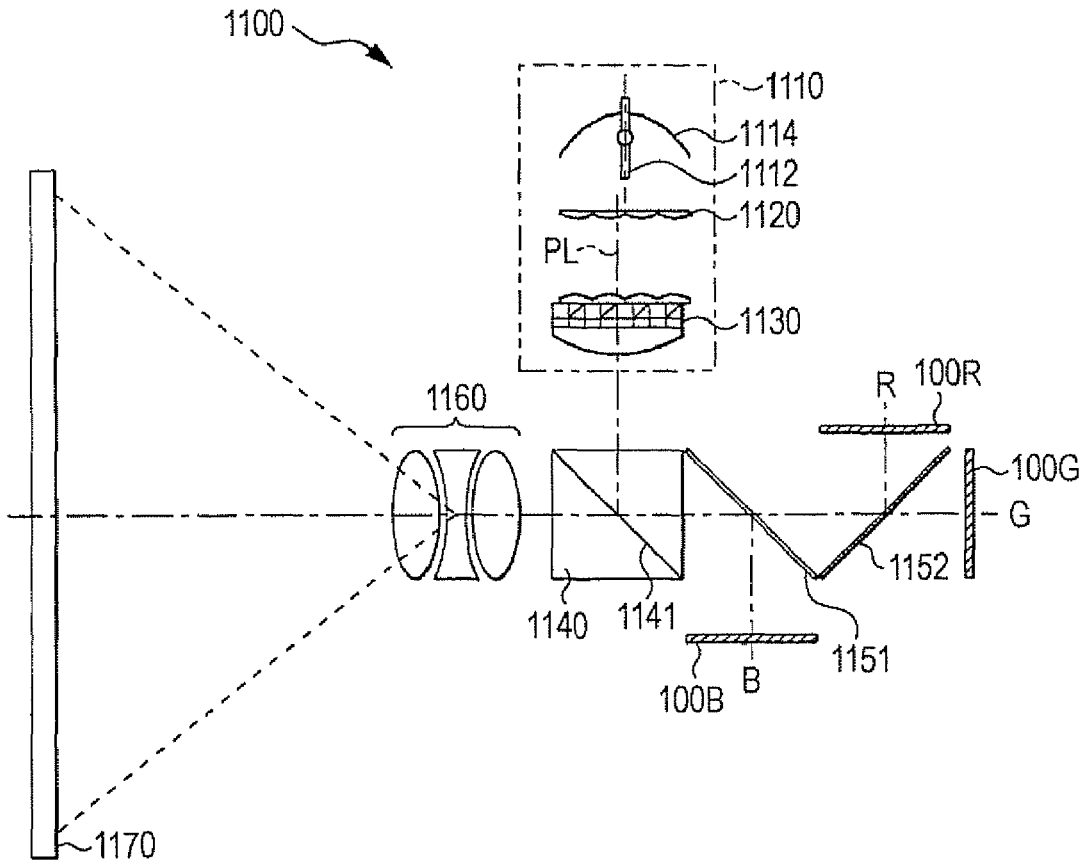
FIG. 22 shows the configuration of a projector that uses an electro-optical apparatus according to the embodiments of the invention.

Next, as an example of an electronic apparatus that uses the electro-optical apparatus according to the above described embodiments, a projector that uses the above described electro-optical apparatus 1 as a light valve will be described. FIG. 22 is a plan view showing the configuration of the projector.

As shown in FIG. 22, the projector 1100 is of a three panel type in which the three reflective electro-optical apparatuses 1 according to the embodiments are respectively used for each of R (red), G (green) and B (blue). The projector 1100 includes a polarizer lighting device 1110 that is arranged along a system optical axis PL. In the polarizer lighting device 1110, light emitted from a lamp 1112 forms substantially parallel beams of light by being reflected on a reflector 1114 and enters a first integrator lens 1120. Owing to this first integrator lens 1120, light emitted from the lamp 1112 is split into a plurality of intermediate beams of light. These intermediate beams of light are converted into polarized beams of light (s polarized beams of light) of one kind, having substantially the same polarization direction by a polarization conversion element 1130 that includes a second integrator lens on the light incidence side, and then exit from the polarizer lighting device 1110.

The s polarized beams of light that exits from the polarizer lighting device 1110 are reflected on an s polarization beam reflection plane 1141 of a polarization beam splitter 1140. Among the reflected beams of light, beams of blue light (B) are reflected on a blue light reflection layer of a dichroic mirror 1151 and modulated by a reflective light valve 100B. In addition, among beams of light that pass through the blue light reflection layer of the dichroic mirror 1151, beams of red light (R) are reflected on a red light reflection layer of the dichroic mirror 1152 and modulated by the reflective light valve 100R. On the other hand, among beams of light that pass through the blue light reflection layer of the dichroic mirror 1151, beams of green light (G) pass through the red light reflection layer of the dichroic mirror 1152 and modulated by a reflective light valve 100G.

Here, the light valves 100R, 100G and 100B are the same as those of the display circuit 100 in the embodiments described above, and are driven by supplied data signals corresponding to colors of R, G and B, respectively. That is, in the projector 1100, the three electro-optical apparatuses 1 that include the display circuit 100 are provided in correspondence with colors of R, G and B, and are driven in sub-fields in accordance with display data corresponding to colors of R, G and B.

Red, green and blue beams of light that are modulated by the light valves 100R, 100G, and 100B are sequentially combined by the dichroic mirrors 1152 and 1151, and the polarization beam splitter 1140 and, after that, projected onto a screen 1170 by a projection optical system 1160. Because beams of light corresponding to primary colors of R, G and B enter the light valves 100R, 100B, and 100G respectively by the dichroic mirrors 1151 and 1152, no color filters are required.

The electronic apparatus may be, in addition to the projector described with reference to FIG. 22, a television, a viewfinder-type or direct-view-type video tape recorder, a car navigation system, a pager, an electronic notebook, an electronic calculator, a word processor, a workstation, a video telephone, a POS terminal, a digital still camera, a cellular phone, or devices provided with a touch panel. Then, needless to say, the electro-optical apparatus according to the invention may be applied to these various electronic apparatuses.

The entire disclosure of Japanese Patent Application No. 2007-170081, filed Jun. 28, 2007 is expressly incorporated by reference herein.

What is claimed is:

1. A method for driving an electro-optical apparatus that has a plurality of pixels arranged at positions corresponding to intersections of a plurality of scanning lines and a plurality of data lines and that performs gray-scale display by applying at least an on or off voltage to each of the pixels for each of a plurality of sub-fields into which one field is divided, the method comprising:

dividing the one field into p (p is an integer of 2 or more) groups and dividing each of the divided groups into two sub-fields if p is even and dividing p−1 of the divided groups into two subfields if p is odd;

setting the p groups to have the same time period;

setting sub-fields forming one field to have time periods that are different from each other;

making sub-fields to which an on or off voltage is applied be consecutive when viewed from one or adjacent fields, and setting a total of time periods of sub-fields to which an on voltage is applied over one field, the total of time being set on the basis of a gray-scale level specified for the pixel; and dividing the plurality of scanning lines into at least first and second groups, and making a field start timing of pixels corresponding to the scanning lines of the first group differ from a field start timing of pixels corresponding to the scanning lines of the second group by at least half the time period of the one field.

2. The method for driving an electro-optical apparatus according to claim 1, wherein the scanning lines of the first group are formed as scanning lines of odd-numbered rows, the scanning lines of the second group are formed as scanning lines of even-numbered rows, and field start timings of the scanning lines of odd-numbered rows and the scanning lines of even-numbered rows adjacent to the scanning lines of odd-numbered rows differ by 180 degrees in terms of phase.

3. The method for driving an electro-optical apparatus according to claim 1, wherein the scanning lines of the first group are formed as scanning lines of odd-numbered rows, the scanning lines of the second group are formed as scanning lines of even-numbered rows, and the scanning lines of odd-numbered rows and the scanning lines of even-numbered rows are alternately selected, and the duration that a scanning line of one row is selected for is made to be equal to the time period corresponding to the sub-field.

4. The method for driving an electro-optical apparatus according to claim 1, wherein each of the pixels includes a liquid-crystal element, and the time period of the shortest sub-field among the sub-fields is set to be shorter than a saturation response time which is the time taken for the reflectance or the transmittance of the liquid-crystal element to be saturated when the on voltage is applied to the liquid-crystal element.

5. The method for driving an electro-optical apparatus according to claim 1, wherein, when viewed from one or adjacent fields, the number of gray-scale levels in which sub-fields to which an on or off voltage is applied are made consecutive is a half or more of the number of representable gray-scale levels in the pixel, and display data that specifies the gray-scale level of the pixel is converted into data that specifies the application of an on or off voltage that is set for each sub-field, and an on or off voltage is applied to the pixel on the basis of the converted data.

6. An electro-optical apparatus comprising:

a plurality of pixels arranged at positions corresponding to intersections of a plurality of scanning lines and a plurality of data lines, the electro-optical apparatus performing gray-scale display by applying at least an on or off voltage to each of the pixels for each of a plurality of sub-fields into which one field is divided, wherein the one field is divided into p (p is an integer of 2 or more) groups, and each divided group is divided into two sub-fields if p is even and p−1 groups are each divided into two sub-fields if p is odd, the p groups are set to have the same time period, sub-fields forming one field are set to have time periods that are different from each other, sub-fields to which an on or off voltage is applied are made consecutive when viewed from one or adjacent fields, and a total of time periods of sub-fields to which an on voltage is applied over one field is set on the basis of a gray-scale level specified for the pixel, and the plurality of scanning lines are divided into at least first and second groups, and a field start timing of the pixels corresponding to the scanning lines of the first group differs from a field start timing of the pixels corresponding to the scanning lines of the second group by at least half the time period of the one field.

7. An electronic apparatus comprising the electro-optical apparatus according to claim 6.

* * * * *